US010961792B2

(12) United States Patent
McKenzie

(10) Patent No.: US 10,961,792 B2
(45) Date of Patent: Mar. 30, 2021

(54) APPARATUS AND METHOD FOR REMOVING MAGNETIC PARTICLES FROM LIQUIDS OR SLURRIES FROM AN OIL OR GAS PROCESS

(71) Applicant: Romar International Limited, Aberdeenshire (GB)

(72) Inventor: Martin McKenzie, Aberdeenshire (GB)

(73) Assignee: Romar International Limited, Aberdeenshire (GB)

( * ) Notice: Subject to any disclaimer, the term of this patent is extended or adjusted under 35 U.S.C. 154(b) by 0 days.

(21) Appl. No.: 16/088,763

(22) PCT Filed: Apr. 3, 2017

(86) PCT No.: PCT/GB2017/050936
§ 371 (c)(1),
(2) Date: Sep. 26, 2018

(87) PCT Pub. No.: WO2017/168182
PCT Pub. Date: Oct. 5, 2017

(65) Prior Publication Data

US 2019/0112883 A1 Apr. 18, 2019

(30) Foreign Application Priority Data

Apr. 1, 2016 (GB) ..... 1605628

(51) Int. Cl.
*B03C 1/14* (2006.01)
*E21B 21/06* (2006.01)
(Continued)

(52) U.S. Cl.
CPC ..... *E21B 21/065* (2013.01); *B03C 1/0332* (2013.01); *B03C 1/14* (2013.01);
(Continued)

(58) Field of Classification Search
CPC ..... B03C 1/033; B03C 1/0332; B03C 1/14; B03C 1/145; B03C 1/284; B03C 1/286;
(Continued)

(56) References Cited

U.S. PATENT DOCUMENTS 3,759,367 A * 9/1973 Elliott ..... B65G 33/00 198/619
3,952,857 A * 4/1976 Nazuka ..... B65G 29/02 198/637
(Continued)

FOREIGN PATENT DOCUMENTS

CN 102641777 A 8/2012
CN 103041916 A 4/2013
(Continued)

OTHER PUBLICATIONS

International Search Report and Written Opinion for PCT/GB2017/050936 filed Apr. 3, 2017, dated Aug. 8, 2017 from the European Patent Office International Searching Authority, 17 pages.

*Primary Examiner* — Joseph C Rodriguez
(74) *Attorney, Agent, or Firm* — Perkins Coie LLP

(57) ABSTRACT

The application provides an apparatus for removing ferrous particles from an oil or gas process liquid or slurry and a method of use. The apparatus has a first inner cylindrical sheath and a second outer cylindrical sheath arranged concentrically on a longitudinal axis to create an annular volume. A helical screw flight on the first or second cylindrical sheaths extends across the annular volume, and a magnet assembly extends along the longitudinal axis, such that ferrous particles are attracted to a surface of the annular volume. The apparatus has an inlet a discharge outlet, and a ferrous particle collection location. The screw flight and the cylindrical sheath operable to rotate with respect to the magnet assembly to convey particles to the collection loca-
(Continued)

tion. The apparatus includes a retaining surface to retain collected particles.

27 Claims, 16 Drawing Sheets

(51) Int. Cl.
*B03C 1/033* (2006.01)
*B03C 1/28* (2006.01)
*B03C 1/30* (2006.01)

(52) U.S. Cl.
CPC ..... *B03C 1/284* (2013.01); *B03C 1/286* (2013.01); *B03C 1/288* (2013.01); *B03C 1/30* (2013.01); *B03C 2201/18* (2013.01); *B03C 2201/22* (2013.01)

(58) Field of Classification Search
CPC ... B03C 1/30; B03C 2201/18; B03C 2201/20; E21B 21/065; E21B 21/066
See application file for complete search history.

(56) References Cited

U.S. PATENT DOCUMENTS 4,498,987 A * 2/1985 Inaba ..... B03C 1/14 209/224
4,784,759 A 11/1988 Elliott
4,818,378 A * 4/1989 Elliott ..... B65G 33/04 198/619
4,976,654 A * 12/1990 Dammann ..... A01F 7/06 460/80
5,170,891 A * 12/1992 Barrett ..... B03C 1/284 198/619
5,427,249 A * 6/1995 Schaaf ..... B03C 1/284 209/223.2
5,667,074 A * 9/1997 Reali ..... B03C 1/14 209/224
5,791,492 A * 8/1998 Reali ..... B03C 1/14 209/221
9,683,417 B2 * 6/2017 McKenzie ..... B03C 1/0332
2004/0020835 A1 2/2004 Chang
2013/0026087 A1 1/2013 McKenzie
2015/0298139 A1 10/2015 Wilkes

FOREIGN PATENT DOCUMENTS

CN 105327774 A 2/2016
DE 11829 C 11/1880
DE 113450 A1 6/1975
EP 0083331 A1 7/1983
JP S54131169 A 10/1979
JP H05104021 A 4/1993
WO 2014161819 A1 10/2014
WO 2015012696 A1 1/2015

* cited by examiner

APPARATUS AND METHOD FOR REMOVING MAGNETIC PARTICLES FROM LIQUIDS OR SLURRIES FROM AN OIL OR GAS PROCESS

The present invention relates to an apparatus and method for handling oil and gas process liquids or slurries. In particular, the invention in one of its aspects relates to an apparatus for handling liquids or slurries flowing from a wellbore operation which contain ferrous particles or swarf and a method of use of such apparatus. One aspect of the invention relates to an apparatus for and method of removing ferrous particles from a liquid flowing from an oil or gas operation. In particular, the invention in one of its aspects relates to an apparatus which can be permanently integrated into a rig package for removing magnetic particles or swarf from a liquid flowing from an oil or gas operation, a method of use and a method of bringing the apparatus online and taking it offline.

BACKGROUND TO THE INVENTION

In the oil and gas exploration and production industry, it is common to cut, mill, grind or drill through steel components such as casing in an installed wellbore, for example to form a window in the wellbore to allow a sidetrack well to be drilled. The material removed by this process (referred to as swarf) is mixed with the drilling fluid (or mud), which is circulated through the wellbore and returned to surface via the wellbore annulus along with the drill cuttings. It is desirable to process the drilling mud returns to remove the drill cuttings for treatment and disposal, and to prepare the drilling mud for recirculation. The swarf is highly erosive and must be removed from the valuable drilling mud to allow it to be reused safely. However, significant quantities of swarf in drilling mud returns may interfere with or damage surface flow equipment including equipment used for the separation of solid particles (such as drill cuttings or rock fragments), presenting the operator with an additional problem.

The ferrous nature of swarf has led to proposals to use magnetic fields to separate the swarf from the fluid or slurry. Various magnetic separator apparatus exist which are able to separate magnetic particles, such as swarf, from a fluid. However, the magnetic particles which are collected by such an apparatus must consequently be removed from the apparatus itself. The removal of magnetic particles from a magnetic separating apparatus is referred to as cleaning, and often requires the need for human intervention, the separator apparatus to be taken out of service and the ongoing process to be halted.

It is therefore desirable for a magnetic separating apparatus to be "self-cleaning", in that it is able to discharge collected magnetic particles without the need for human intervention or the requirement to remove the apparatus from service resulting in system down-time.

U.S. Pat. Nos. 5,170,891 and 4,818,378 describe self-cleaning screw conveyor apparatus which are internally magnetised to attract and convey magnetic material. The magnetic field strength created by the apparatus of U.S. Pat. No. 5,170,891 is designed to be strong at one end of the screw conveyor, to pick up magnetic particles, and weaker at the other, to discharge magnetic particles. U.S. Pat. No. 4,818,378 has multiple discharge chutes at its end, and relies on weaknesses in the magnetic field of its magnetic arrangement to encourage discharge of collected magnetic particles. Cleaning of U.S. Pat. No. 4,818,378 can also be assisted by an externally mounted sweeping apparatus, which rotates independently of the conveyor. FR 2 722 120, U.S. Pat. No. 4,784,759 and US 2015/0298139 describe screw conveyor apparatus which are enclosed and externally magnetised.

WO 2007/023726, filed by the present applicant, describes a screw conveyor apparatus which is internally magnetised. In WO 2007/023726, the helical flights of the screw conveyor rotate relative to the central, internally magnetised, shaft. The rotating helical flights move the collected magnetic particles away from the internal magnetic arrangement of the conveyor allowing particles to fall from the conveyor when no longer attracted by the magnetic field.

The foregoing screw conveyor apparatus each have the capacity to attract and convey magnetic particles and subsequently discharge the majority of the magnetic particles which have been collected. However, such apparatus face problems in discharging all of the magnetic material that has been collected, in particular, magnetic particles which are very small. The inability of the magnetic separating apparatus to ensure total and proper discharge of such material may result in damage and clogging of the apparatus, as well as interfering with the ability of the apparatus to perform its function.

It is also desirable for a magnetic separating apparatus to be self-cleaning while retaining an ability to effectively and adequately separate swarf or magnetic particles from a liquid or slurry.

Furthermore, while the magnetic separating apparatus proposed in the above-referenced are applicable to a wide range of applications, they are not suitable for integration, permanent or otherwise, into a flowline of a rig package of the oil and gas exploration and production industry.

SUMMARY OF THE INVENTION

There is generally a need for an apparatus and method for separating ferrous material from a liquid or slurry which addresses one or more drawbacks of known methods and/or apparatus.

It is amongst the objects of the invention to provide an apparatus and method of use for separating ferrous material from a liquid or slurry which addresses one or more drawbacks of known methods and/or apparatus.

Other aims and objects of the invention include providing an improved apparatus and method of use which can be integrated, permanently or otherwise, into a flowline of a rig package.

A further aim of at least one aspect or embodiment of the invention is to provide a method of bringing an apparatus online, and/or taking it offline when permanently integrated into a flowline of a rig package.

It is an aim of the present invention to provide an apparatus and method for handling oil and gas process liquids or slurries which contain magnetic particles or swarf which address one or more drawbacks or deficiencies of the previously proposed apparatus and methods.

One aim of the invention is to provide an improved apparatus for and method of removing ferrous particles from an oil or gas process liquid (such as drilling mud). An additional aim is to provide a self-cleaning apparatus for and method of separating magnetic particles from a liquid or slurry flowing from an oil or gas operation (such as drilling mud).

Further aims and aspects of the invention will become apparent from the following description.

According to a first aspect of the invention, there is provided an apparatus for removing ferrous particles from an oil or gas process liquid or slurry, the apparatus comprising:

a first inner cylindrical sheath and a second outer cylindrical sheath arranged concentrically on a longitudinal axis to create an annular volume therebetween;

at least one helical screw flight on one of the first or second cylindrical sheaths, and extending substantially or fully across the annular volume;

a magnet assembly extending along at least a part of the longitudinal axis, such that ferrous particles are attracted to an internal cylindrical surface of the annular volume;

an inlet for a liquid or slurry to enter the annular volume;

a liquid or slurry discharge outlet from the annular volume;

a ferrous particle collection location at one end of the apparatus;

wherein the at least one screw flight and the cylindrical sheath on which it is mounted is operable to be rotated with respect to the magnet assembly to convey particles along the apparatus to the ferrous particle collection location;

and wherein the at least one helical screw flight of the apparatus further comprises a retaining surface configured to retain collected particles as they are conveyed towards the ferrous particle collection location.

In the context of this specification, the term "helical screw flight" or "flight" is used to describe any element comprising at least one helix turn, extending over one helical pitch on the apparatus. For convenience, adjacent parts of a single continuous helix (as described in embodiments of the invention) may be referred to herein as separate flights, although they may constitute different parts of a single continuous helix.

The retaining surface may be in the form of a wall or a barrier which may extend in the longitudinal direction of the apparatus, and/or which may extend from at least part of the radial outer edge of the at least one helical screw flight.

The retaining surface may extend in the longitudinal direction of the apparatus from at least part of the radial outer edge of the at least one helical screw flight.

The retaining surface may be a helical retaining surface.

The retaining surface may extend in a direction towards the end of the apparatus at which the ferrous particle collection location is located. The retaining surface may extend in a direction in which liquid or slurry moves and/or flows through the apparatus.

The distance between two consecutive helices of the at least one helical screw flight may be referred to as the "pitch" of the at least one helical screw flight. The distance by which the retaining surface extends from the outer edge of the at least one helical screw flight may be referred to as the "width" of the retaining surface. The retaining surface may extend from at least part of the radial outer edge of the at least one helical screw flight partially along the distance of the pitch.

The retaining surface may extend from at least part of the radial outer edge of the at least one helical screw flight by around 20% to 80% of the distance of the pitch (i.e. the width of the retaining surface is around 20% to 80% of the pitch).

The retaining surface may extend from at least part of the radial outer edge of the at least one helical screw flight by around 40% to 60% of the distance of the pitch (i.e. the width of the retaining surface is around 40% to 60% of the pitch).

Preferably, the retaining surface extends from at least part of the radial outer edge of the at least one helical screw flight by approximately 50% of the distance of the pitch (i.e. the width of the retaining surface is approximately 50% of the pitch).

The width of the retaining surface may taper towards its start and end points.

Multiple retaining surfaces may be provided. If multiple retaining surfaces are provided on the at least one helical screw flight in different locations, said multiple retaining surfaces may be of different and/or varying depths.

The retaining surface may only be provided on some portions of the at least one helical screw flight. Alternatively, the retaining surface may be provided on the entire helical screw flight.

The retaining surface may be provided on the at least one helical screw flight on at least the portion located adjacent to the liquid or slurry discharge outlet. Alternatively, or in addition, the retaining surface may be omitted from the at least one helical screw flight on the portion located adjacent to the inlet of the apparatus. Alternatively, or in addition, the retaining surface may be omitted from the at least one helical screw flight on the portion located adjacent to the ferrous particle collection location.

The retaining surface and the at least one helical screw flight may be formed as one part. Alternatively, or in addition, the retaining surface and the at least one helical screw flight may be provided as separate parts which may be connected together permanently or detachably.

The apparatus may be oriented horizontally, vertically, or it may be mounted at an angle (inclined).

The magnet assembly may comprise a plurality of magnets, which may be positioned inside the first inner cylindrical sheath of the apparatus.

The plurality of magnets of the magnet assembly may be supported in a magnet mounting frame, which may comprise a central section and a plurality of magnet mounts installed on the central section.

Preferably, the magnet mounting frame is formed from a material which is substantially non-magnetic.

The magnet mounting frame may be formed from a non-magnetic stainless steel.

The magnet assembly may be configured to generate the same magnetic field distribution along the longitudinal axis of the apparatus.

The magnet assembly may extend over a first longitudinal portion of the apparatus and may provide a first magnetic field distribution which may attract ferrous particles to a surface in the annular volume. Alternatively, or in addition, the magnet assembly may extend over a second longitudinal portion of the apparatus, which may be proximal the ferrous particle collection location, and which may provide a second magnetic field distribution.

The retaining surface may be provided on the at least one helical screw flight in at least some of the first longitudinal portion of the of the apparatus. The retaining surface may be omitted on the at least one helical screw flight in the area which is located proximate the inlet of the apparatus. The retaining surface may be provided on the at least one helical screw flight in the first longitudinal portion of the of the apparatus, and may be omitted from the area which is located proximate the inlet of the apparatus.

The retaining surface may be omitted from the at least one helical screw flight in the second longitudinal portion of the apparatus.

The first longitudinal portion of the apparatus may extend from the inlet of the apparatus, to a point past the liquid or slurry discharge outlet and the second longitudinal portion of the apparatus may extend from a point past the liquid or slurry discharge outlet to the ferrous particle collection location.

Along some longitudinal portions of the apparatus, the magnet assembly may comprise no magnets and may be configured to generate zero magnetic field distribution.

The magnet assembly may be configured to generate a gradually reducing magnetic field along the longitudinal axis of the apparatus. Alternatively, there may be a step change in the first and second magnetic field distributions.

The first magnetic field distribution generated by the magnet assembly may be such that the magnetic field strength and/or magnetic flux density is greater than the second magnetic field distribution, on average over the surfaces of the inner cylindrical sheath in the first and second longitudinal portions.

The second magnetic field distribution may be such that the magnetic field strength and/or magnetic flux density is reduced compared with the first magnetic field distribution, negligible, or zero over circumferential portions of first inner cylindrical sheath.

The inlet of the apparatus may be located at or adjacent the first longitudinal portion.

The magnet assembly may comprise a plurality of longitudinal magnets, each of which may comprise a plurality of magnetic units. The plurality of longitudinal magnets may be circumferentially distributed around the longitudinal axis of the apparatus. The magnet assembly may be configured to generate the same magnetic field distribution along the longitudinal axis of the apparatus. The same number and arrangement of longitudinal magnets may be provided along the longitudinal axis of the apparatus. Alternatively, the second longitudinal potion may comprise no magnets.

The first longitudinal portion may comprise a plurality of longitudinal magnets circumferentially distributed around the longitudinal axis of the apparatus. The second longitudinal portion may comprise at least one longitudinal magnet circumferentially distributed around the longitudinal axis of the apparatus.

The apparatus may be divided into further longitudinal portions over which different magnetic field distributions may be provided.

Any number of longitudinal magnets and arrangements thereof may be used, in any longitudinal portion of the apparatus. For example, two longitudinal magnets may be provided, which may be arranged at an angular spacing of 180 degrees to one another. Alternatively, four longitudinal magnets may be provided, which may be arranged at an angular spacing of 90 degrees to one another. The number of longitudinal magnets and/or angular spacing between each of the longitudinal magnets may not be even.

Different numbers and circumferential arrangements (angular spacing) of longitudinal magnets may be used in different longitudinal portions of the apparatus.

Preferably, two longitudinal magnets are provided along the entire longitudinal axis of the apparatus, arranged at an angular spacing of 180 degrees to one another.

The at least one helical screw flight of the apparatus may extend substantially along the length of the first or second cylindrical sheaths.

The apparatus may comprise an end flange. The end flange may have the same outer diameter as that formed by the at least one helical screw flight.

The apparatus may further comprise a particle release surface which may be oriented substantially longitudinally in the annular volume of the apparatus. The particle release surface may be located adjacent the ferrous particle collection location and/or may be located in the second longitudinal portion of the apparatus. The particle release surface may be operable to be rotated with respect to the magnet assembly and/or may move ferrous particles around the apparatus to a region of low magnetic field strength to release them at the ferrous particle collection location.

The particle release surface may be provided between an end of the helical screw flight and an end flange.

The particle release surface may extend radially outwards from the first inner cylindrical sheath, and/or may connect the outer edges of an end of the helical screw flight and an end flange.

The first inner cylindrical sheath of the apparatus, the at least one helical screw flight and the retaining surface may be joined to form a screw conveyor.

The first inner cylindrical sheath of the apparatus, the at least one helical screw flight, the retaining surface, the end flange and the particle release surface may be joined to form a screw conveyor.

The apparatus may comprise a motor operable to rotate the screw conveyor.

Alternatively, or in addition, the apparatus may comprise a motor operable to rotate the internal magnet assembly.

In one embodiment, the screw conveyor is rotated relative to the internal magnet assembly, which is held stationary.

The apparatus may be driven in several different ways, including but not limited to: rotating the screw conveyor whilst the internal magnet assembly remains stationary; rotating the internal magnet assembly whilst the screw conveyor remains stationary; and simultaneously rotating the screw conveyor and the internal magnet assembly relative to one another, either in the same or in opposite directions. Alternatively, both the screw conveyor and the internal magnet assembly may remain stationary whilst permitting the flow of fluid through the apparatus.

In addition, the azimuth angle of the internal magnet assembly may be adjusted with respect to the apparatus to ensure optimum operation of the apparatus.

The plurality of magnetic units of each longitudinal magnet may be arranged with their repelling poles adjacent to one another.

The magnet assembly of the apparatus may comprise one or more spacers, which may be a spacing plate or spacing disc, which may be arranged between adjacent magnetic units of the longitudinal magnets. The spacers may be substantially planar, and/or may be substantially circular. The spacers may comprise an aperture in their centres, permitting them to be slotted on to a central section between each magnetic unit.

Preferably, the magnet assembly of the apparatus may comprise a retaining means, which may retain the magnetic units in place against a repelling force.

The retaining means may comprise a plurality of retaining members or plates, which may be located in circumferential positions corresponding to the positions of the magnetic units. The retaining means may be arranged around outer edges of spacers.

The spacers and/or the retaining means may be formed from a substantially non-magnetic material, such as a non-magnetic stainless steel.

According to a second aspect of the invention, there is provided an apparatus for removing ferrous particles from an oil or gas process liquid or slurry, the apparatus comprising: a first inner cylindrical sheath and a second outer cylindrical sheath arranged concentrically on a longitudinal axis to create an annular volume therebetween; at least one helical screw flight on one of the first or second cylindrical sheaths, and extending substantially or fully across the annular volume;

a magnet assembly extending along at least a part of the longitudinal axis, such that ferrous particles are attracted to an internal cylindrical surface of the annular volume; an inlet for a liquid or slurry to enter the annular volume;

a liquid or slurry discharge outlet from the annular volume;

a ferrous particle collection location at one end of the apparatus;

wherein the at least one screw flight and the cylindrical sheath on which it is mounted is operable to be rotated with respect to the magnet assembly to convey particles along the apparatus to the ferrous particle collection location;

and wherein the apparatus further comprises a particle release surface, oriented substantially longitudinally in the annular volume of the apparatus and adjacent the ferrous particle collection location, and wherein the particle release surface is operable to be rotated with respect to the magnet assembly to move ferrous particles around the apparatus to a region of low magnetic field strength and release them at the ferrous particle collection location.

The apparatus may further comprise a retaining surface configured to retain collected particles as they are conveyed towards the ferrous particle collection location, which may be located on the at least one helical screw flight of the apparatus. The retaining surface may extend in the longitudinal direction of the apparatus from at least part of the radial outer edge of the at least one helical screw flight.

The first inner cylindrical sheath of the apparatus, the at least one helical screw flight, an end flange, the particle release surface and the retaining surface may be joined to form a screw conveyor.

Embodiments of the second aspect of the invention may include one or more features of the first aspect of the invention or its embodiments, or vice versa.

According to a third aspect of the invention, there is provided an apparatus for removing ferrous particles from an oil or gas process liquid or slurry, the apparatus comprising: a first inner cylindrical sheath and a second outer cylindrical sheath arranged concentrically on a longitudinal axis to create an annular volume therebetween; at least one helical screw flight on one of the first or second cylindrical sheaths, and extending substantially or fully across the annular volume;

a magnet assembly extending along at least a part of the longitudinal axis, such that ferrous particles are attracted to an internal cylindrical surface of the annular volume; an inlet for a liquid or slurry to enter the annular volume;

a liquid or slurry discharge outlet from the annular volume;

a ferrous particle collection location at one end of the apparatus;

wherein the at least one screw flight and the cylindrical sheath on which it is mounted is operable to be rotated with respect to the magnet assembly to convey particles along the apparatus to the ferrous particle collection location;

wherein the magnet assembly extends over a first longitudinal portion of the apparatus to provide a first magnetic field distribution for attracting ferrous particles to a surface in the annular volume, and extends over a second longitudinal portion of the apparatus proximal the ferrous particle collection location to provide a second magnetic field distribution; and wherein the apparatus further comprises a particle release surface, oriented substantially longitudinally in the annular volume in the second longitudinal portion of the apparatus and adjacent the ferrous particle collection location, and wherein the particle release surface is operable to be rotated with respect to the magnet assembly to move ferrous particles around the apparatus to a region of low magnetic field strength and release them at the ferrous particle collection location.

The apparatus may further comprise a retaining surface configured to retain collected particles as they are conveyed towards the ferrous particle collection location, which may be located on the at least one helical screw flight of the apparatus. The retaining surface may extend in the longitudinal direction of the apparatus from at least part of the radial outer edge of the at least one helical screw flight.

The first inner cylindrical sheath of the apparatus, the at least one helical screw flight, an end flange, retaining surface and the particle release surface may be joined to form a screw conveyor.

Embodiments of the third aspect of the invention may include one or more features of the first or second aspects of the invention or their embodiments, or vice versa.

According to a fourth aspect of the invention, there is provided an apparatus for removing ferrous particles from an oil or gas process liquid or slurry, the apparatus comprising:

a cylindrical sheath on a longitudinal axis;

at least one helical screw flight on the cylindrical sheath;

a magnet assembly arranged inside the cylindrical sheath and extending along at least a part of the longitudinal axis, such that ferrous particles are attracted to an outer cylindrical surface of the sheath;

a ferrous particle collection location at one end of the apparatus;

wherein the magnet assembly is operable to be rotated within the cylindrical sheath and with respect to the at least one screw flight and the cylindrical sheath mounted to convey particles along the apparatus to the ferrous particle collection location;

wherein the magnet assembly extends over a first longitudinal portion of the apparatus to provide a first magnetic field distribution for attracting ferrous particles to a surface in the annular volume, and extends over a second longitudinal portion of the apparatus proximal the ferrous particle collection location to provide a second magnetic field distribution;

wherein the apparatus further comprises a particle release surface, oriented substantially longitudinally on the cylindrical sheath in the second longitudinal portion of the apparatus and adjacent the ferrous particle collection, and wherein the magnet assembly is operable to be rotated with respect the particle release surface to move ferrous particles around the apparatus to region of low magnetic field strength and release them at the ferrous particle collection location.

Embodiments of the fourth aspect of the invention may include one or more features of the first to third aspects of the invention or their embodiments, or vice versa.

According to a fifth aspect of the invention, there is provided a method of removing magnetic particles from an oil or gas process liquid or slurry, the method comprising:

providing a magnetic separating apparatus comprising:

a cylindrical sheath on a longitudinal axis;

at least one helical screw flight on the cylindrical sheath;

a magnet assembly arranged inside the cylindrical sheath and extending along at least a part of the longitudinal axis wherein the magnet assembly extends over a first longitudinal portion of the apparatus to provide a first magnetic field distribution and extends over a second longitudinal portion of the apparatus proximal a ferrous particle collection location at one end of the apparatus to provide a second magnetic field distribution;

wherein the apparatus further comprises a particle release surface, oriented substantially longitudinally on the cylindrical sheath in the second longitudinal portion of the apparatus and adjacent the ferrous particle collection;

exposing the cylindrical sheath to an oil or gas process liquid or slurry such that ferrous particles which are contained within the liquid or slurry are attracted to the outer surface of the cylindrical sheath by the first magnetic field distribution of magnet assembly; rotating the cylindrical sheath and the at least one helical screw flight relative to the magnet assembly to convey particles along the apparatus towards the particle release surface;

rotating the particle release surface relative to the magnet assembly to move ferrous particles around the apparatus to a region of low magnetic field strength and release them at the ferrous particle collection location.

Embodiments of the fifth aspect of the invention may include one or more features of the first to fourth aspects of the invention or their embodiments, or vice versa.

According to a sixth aspect of the invention, there is provided a method of removing magnetic particles from an oil or gas process liquid or slurry, the method comprising: providing a magnetic separating apparatus comprising:

a cylindrical sheath on a longitudinal axis;

at least one helical screw flight on the cylindrical sheath;

a magnet assembly arranged inside the cylindrical sheath and extending along at least a part of the longitudinal axis; and a ferrous particle collection location;

wherein the apparatus further comprises a particle release surface, oriented substantially longitudinally on the cylindrical sheath adjacent the ferrous particle collection;

exposing the cylindrical sheath to an oil or gas process liquid or slurry such that ferrous particles which are contained within the liquid or slurry are attracted to the outer surface of the cylindrical sheath by the magnet assembly;

rotating the cylindrical sheath and the at least one helical screw flight relative to the magnet assembly to convey particles along the apparatus towards the particle release surface;

rotating the particle release surface relative to the magnet assembly to move ferrous particles around the apparatus to a region of low magnetic field strength and release them at the ferrous particle collection location.

The apparatus may further comprise a retaining surface configured to retain collected particles as they are conveyed towards the ferrous particle collection location which may be positioned on the at least one helical screw flight of the apparatus and which may extend in the longitudinal direction of the apparatus from at least part of the radial outer edge of the at least one helical screw flight The method may comprise retaining collected particles using the retaining surface.

Embodiments of the sixth aspect of the invention may include one or more features of the first to fifth aspects of the invention or their embodiments, or vice versa.

According to a seventh aspect of the invention, there is provided a method of removing magnetic particles from an oil or gas process liquid or slurry, the method comprising: providing a magnetic separating apparatus comprising:

a cylindrical sheath on a longitudinal axis;

at least one helical screw flight on the cylindrical sheath;

a magnet assembly arranged inside the cylindrical sheath and extending along at least a part of the longitudinal axis; and a ferrous particle collection location;

wherein the at least one helical screw flight of the apparatus further comprises a retaining surface;

exposing the cylindrical sheath to an oil or gas process liquid or slurry such that ferrous particles which are contained within the liquid or slurry are attracted to the outer surface of the cylindrical sheath by the magnet assembly;

rotating the cylindrical sheath and the at least one helical screw flight relative to the magnet assembly to convey particles along the apparatus towards the ferrous particle collection location;

retaining collected particles using the retaining surface; and releasing particles at the ferrous particle collection location.

The retaining surface may be configured to retain collected particles as they are conveyed towards the ferrous particle collection location.

The retaining surface may extend in the longitudinal direction of the apparatus from at least part of the radial outer edge of the at least one helical screw flight.

The method may comprise retaining particles using the retaining surface in only some portions of the apparatus.

The method may comprise releasing particles at the ferrous particle collection location by moving ferrous particles around the apparatus to a region of low magnetic field strength.

The apparatus may further comprise a particle release surface, oriented substantially longitudinally on the cylindrical sheath adjacent the ferrous particle collection.

The method may comprise rotating the cylindrical sheath and the at least one helical screw flight relative to the magnet assembly to convey particles along the apparatus towards the particle release surface.

The method may comprise rotating the particle release surface relative to the magnet assembly to move ferrous particles around the apparatus to a region of low magnetic field strength and release them at the ferrous particle collection location.

Embodiments of the seventh aspect of the invention may include one or more features of the first to sixth aspects of the invention or their embodiments, or vice versa.

According to an eighth aspect of the invention, there is provided a magnet assembly for an apparatus for removing ferrous particles from an oil or gas process liquid or slurry, the magnet assembly comprising:

a plurality of magnets;

a magnet mounting frame;

at least one spacing plate; and at least one retaining member.

The plurality of magnets of the magnet assembly may be supported in the magnet mounting frame. The magnet mounting frame may comprise a central section. The magnet mounting frame may comprise a plurality of magnet mounts installed on the central section.

Preferably, the magnet mounting frame is formed from a material which is substantially non-magnetic.

The magnet mounting frame may be formed from a non-magnetic stainless steel.

The plurality of magnets may be a plurality of longitudinal magnets. Each longitudinal magnet may comprise a plurality of magnetic units. The plurality of magnetic units of each longitudinal magnet may be arranged with their repelling poles adjacent to one another.

The plurality of longitudinal magnets may be circumferentially distributed around the longitudinal axis of the magnet mounting frame.

The at least one spacing plate may be of any suitable shape, for example, it may be square or rectangular. Alternatively, the at least one spacing plate may be in the form of a disc. The at least one spacing plate may be substantially planar, and/or may be substantially circular.

The at least one spacing plate may be arranged between adjacent magnetic units of the longitudinal magnets. The at least one spacing plate may comprise an aperture in its centre, which may permit it to be slotted on to the magnet mounting frame.

The at least one spacing plate may comprise an aperture in its centre, which may permit it to be slotted on to the central section of the magnet mounting frame. The at least one spacing disc may be slotted on to the central section of the magnet mounting frame between each magnetic unit.

The at least one retaining member may provide a retaining means, which may retain the magnetic units in place against a repelling force.

Preferably, a plurality of retaining members is provided, which may be located in circumferential positions corresponding to the positions of the magnetic units.

The retaining members may be arranged around outer edges of at least one spacing plates.

The spacing plates and/or the retaining members may be formed from a substantially non-magnetic material, such as a non-magnetic stainless steel.

Embodiments of the eighth aspect of the invention may include one or more features of the first to seventh aspects of the invention or their embodiments, or vice versa.

According to a ninth aspect of the invention, there is provided an oil or gas exploration or production facility comprising the apparatus of the first to fourth aspects of the invention or its embodiments.

Embodiments of the ninth aspect of the invention may include one or more features of the first to eighth aspects of the invention or their embodiments, or vice versa.

BRIEF DESCRIPTION OF THE DRAWINGS

There will now be described, by way of example only, various embodiments of the invention with reference to the drawings, of which:

FIG. 10 is an isometric exploded view of part of the internal magnet assembly of FIG. 9.

DETAILED DESCRIPTION OF PREFERRED EMBODIMENTS

Figure 1A:
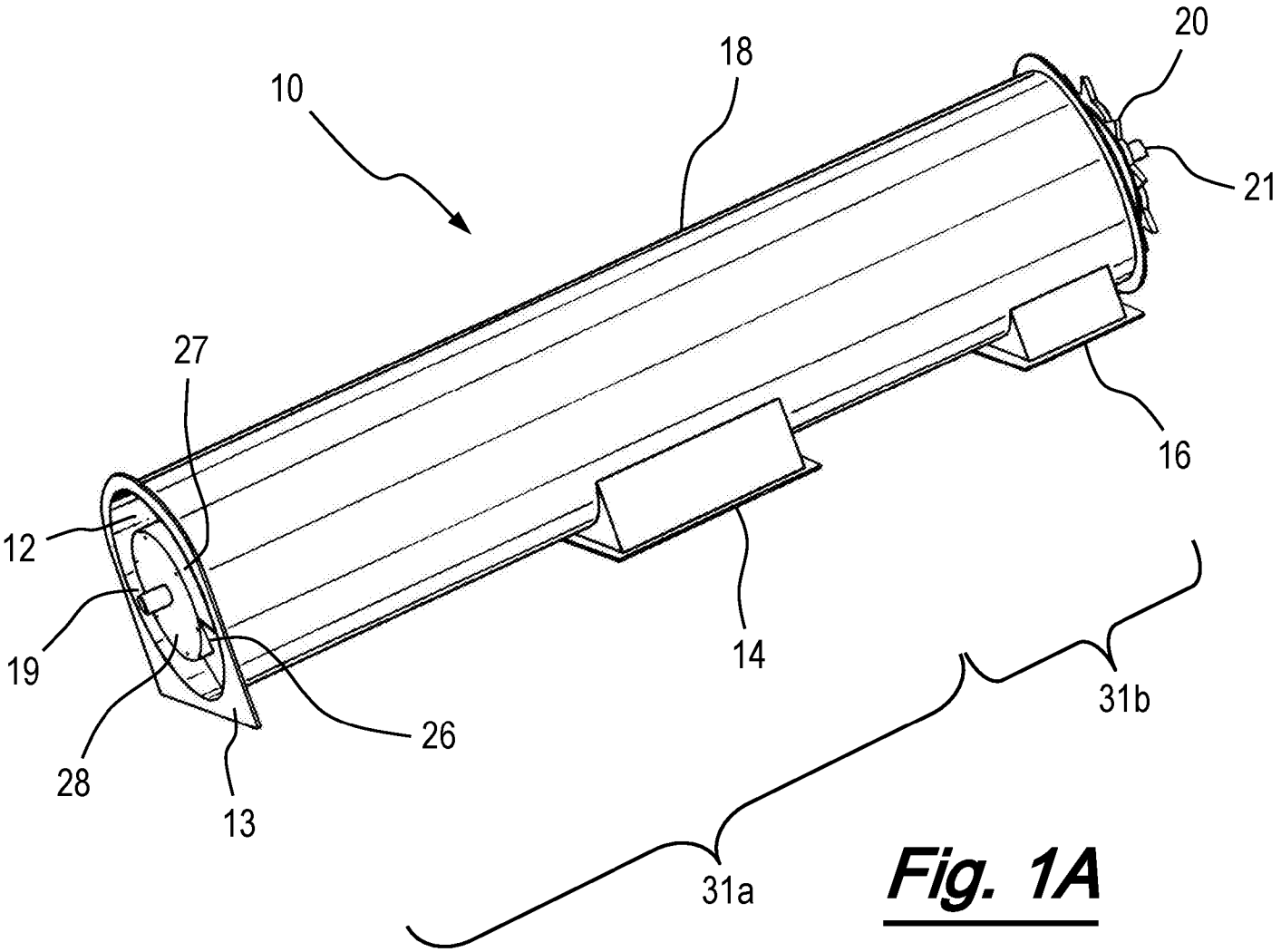
FIG. 1A is an isometric view of the assembled magnetic separator apparatus, according to an embodiment of the invention.
Figure 1C:
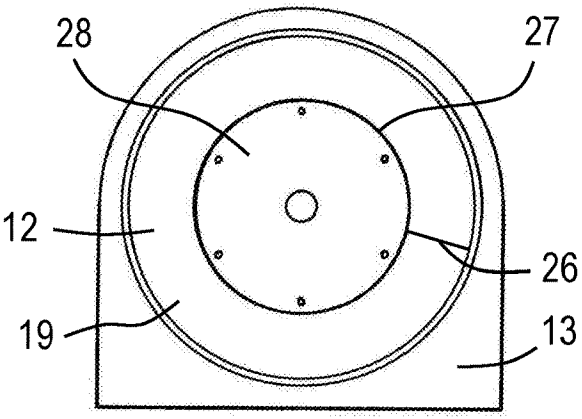
FIGS. 1B, 10 and 1D are schematic isometric, front and end views respectively of the assembled magnetic separator apparatus of FIG. 1A.

Referring firstly to FIGS. 1A to 1D, there is shown generally at 10 a magnetic separator apparatus according to a first embodiment of the invention. The apparatus comprises first inner and second outer cylindrical sheaths 27, 18 respectively, arranged concentrically on a longitudinal axis to define an annular volume 19 between the two sheaths. Helical screw flight 26 extends along the length of the inner cylindrical sheath 27 and through annular volume 19. The flights 26 are fixed to sheath 27, to form a screw conveyor, generally shown at 29 in FIG. 1B, in which a part of the outer cylindrical sheath 18 is omitted to show internal components. The outer diameter of the screw conveyor 29, which is formed by the helical screw flight 26, is less than the inner diameter of the outer cylindrical sheath 18, allowing the screw conveyor 29 to rotate within the outer sheath 18 without interference. Inner cylindrical sheath 27 houses an internal magnet assembly and various drive connections (not shown in FIGS. 1A to 1D), enclosed by endplate 28. The apparatus has an inlet 12, a liquid or slurry discharge outlet 14 and a ferrous particle outlet 16. The inlet 12 and the liquid or slurry discharge outlet 14 lie radially within a first longitudinal portion of the apparatus 31*a* while the ferrous particle outlet 16 lies radially within a second longitudinal portion of the apparatus. The first and second longitudinal portions of the apparatus relate to longitudinal portions of the apparatus which may subject to different magnetic field strengths, as will become apparent in the following description. The apparatus also has a stand 13 at its front end.

Figure 1D:
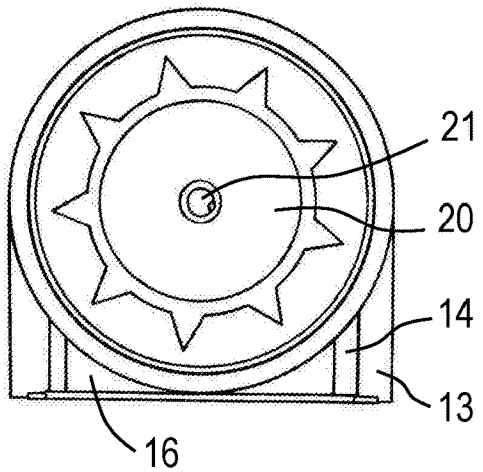
Figure 1B:
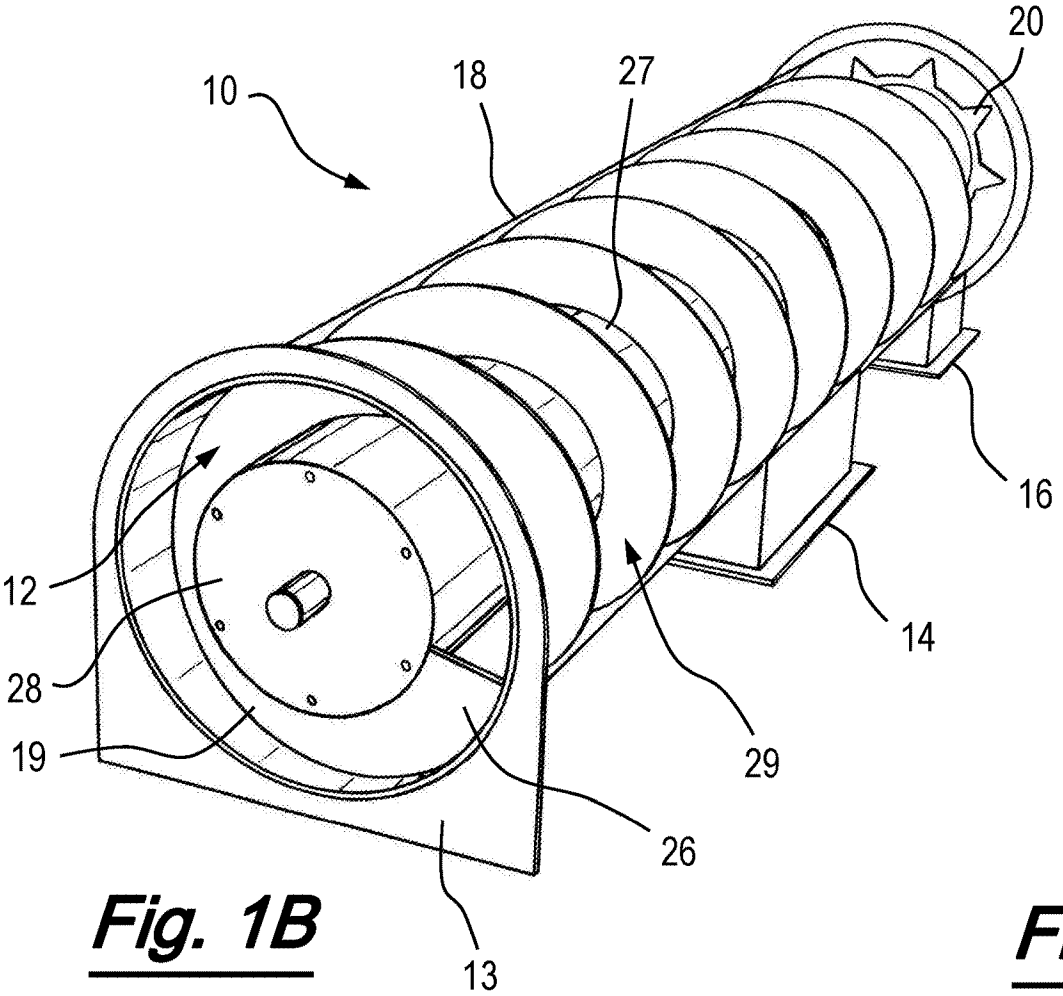
Figure 10:
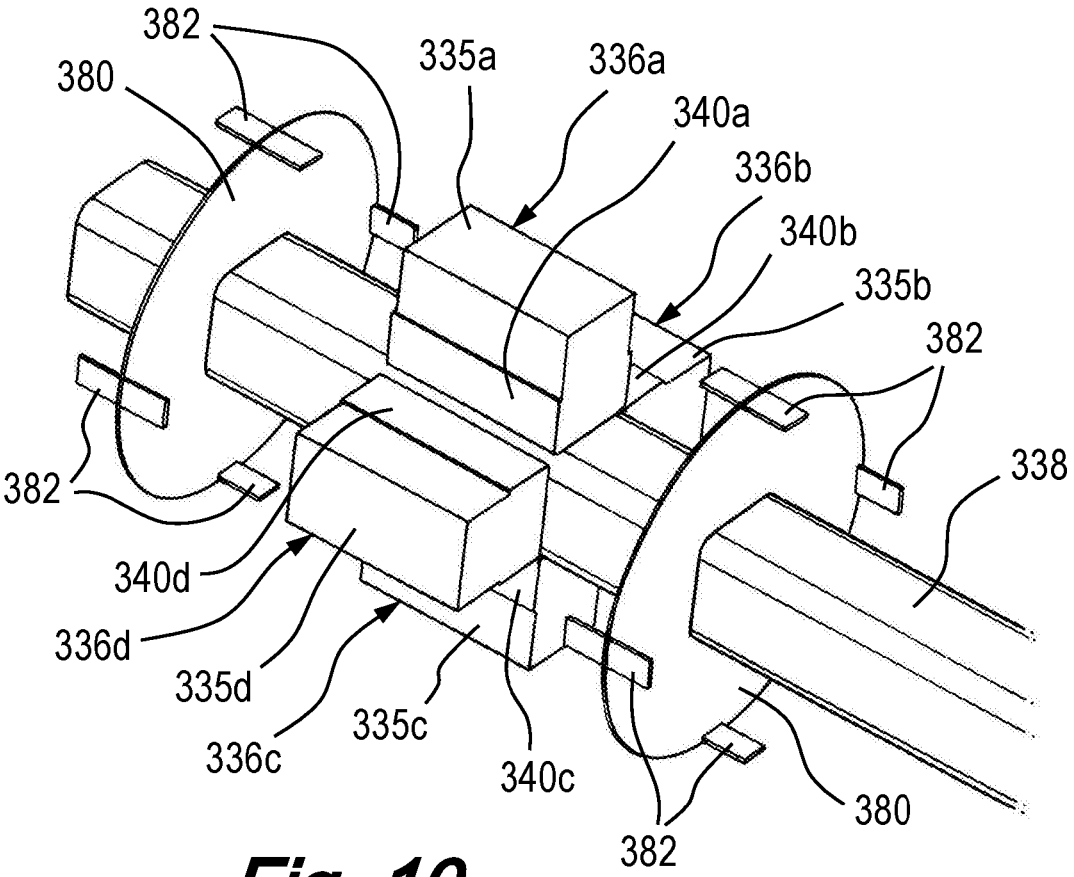

FIGS. 10 and 1D are front and end views of the magnetic separating apparatus, respectively. At the end of the magnetic separator apparatus is sprocket 20 which is coupled to the inner cylindrical sheath 27 and driven by a motor (not shown) to rotate the screw conveyor 29 within the outer cylindrical sheath 18. Shaft 21 is also provided to selectively and independently rotate the internal magnet assembly relative to the screw conveyor 29. The apparatus may be driven in several ways, including: rotating the screw conveyor 29 whilst the internal magnet assembly remains stationary; rotating the internal magnet assembly whilst the screw conveyor 29 remains stationary; and simultaneously rotating the screw conveyor 29 and the internal magnet assembly relative to one another, either in the same or in opposite directions. Alternatively, both the screw conveyor 29 and the internal magnet assembly can remain stationary whilst permitting the flow of fluid through the apparatus.

Figure 2:
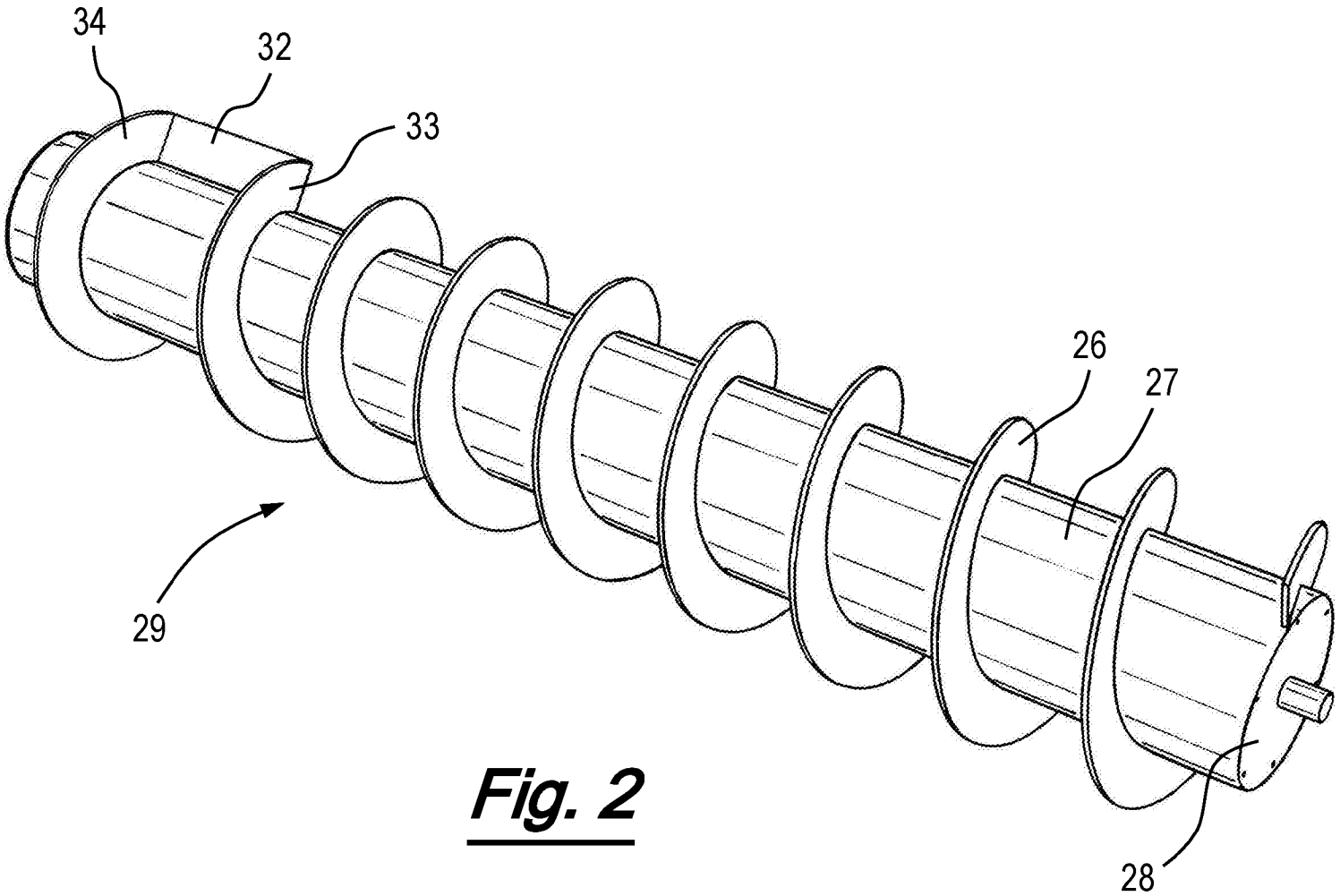
FIG. 2 is a schematic isometric view of the screw conveyor of the magnetic separator of FIG. 1A.

FIG. 2 shows in more detail the screw conveyor 29 of the magnetic separator of FIG. 1A. Helical screw flight 26 extends along the length of inner cylindrical sheath 27 of the screw conveyor 29 until a point towards its end. At this point, a particle release surface 32 is provided between an end of helical flight 33 and end flange 34. End flange 34 has the same outer diameter as that formed by flights 26. Particle release surface 32 extends radially outwards from the inner cylindrical sheath 27 to connect the outer edges of the end of the helical flight 33 and end flange 34.

Referring now to FIGS. 3A to 6, details of an example embodiment of the internal magnet assembly, shown generally at 30, and its respective drive connections, shown generally at 37, are shown. The internal magnet assembly 30 is contained within the screw conveyor 29, formed by helical screw flight 26 and inner cylindrical sheath 27, and comprises magnets 36*a*, 36*b*, 36*c*, 36*d*, and a magnet mounting frame which comprises central section 38 and magnet mounts 40*a*, 40*b*, 40*c*, 40*d*. The drive connections 37, which facilitate the rotation of the internal magnet assembly 30 relative to the screw conveyor 29, comprise end plate 28, gasket 42, flange 44, front and rear bushes 46*a*, 46*b* respectively, gudgeon pin 48 and gudgeon drive pin 50. It will be appreciated that a different combination of these parts, or indeed other parts, may be used to form the drive connections of the internal magnet assembly in other embodiments of the invention.

Figure 3A:
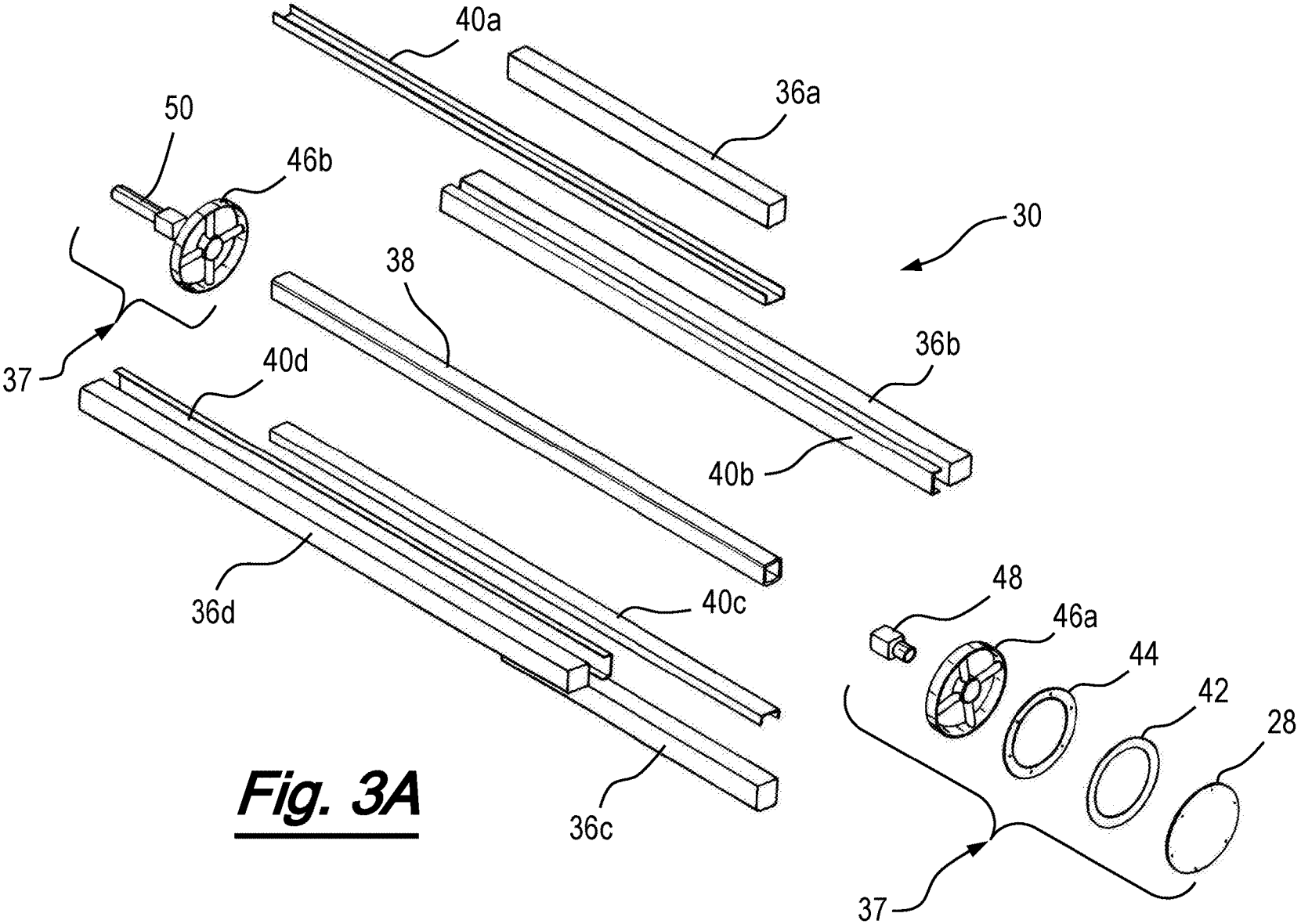
FIGS. 3A and 3B are respectively exploded isometric and assembled schematic perspective views of the internal magnet assembly of the magnetic separator of FIG. 1A.
Figure 3B:
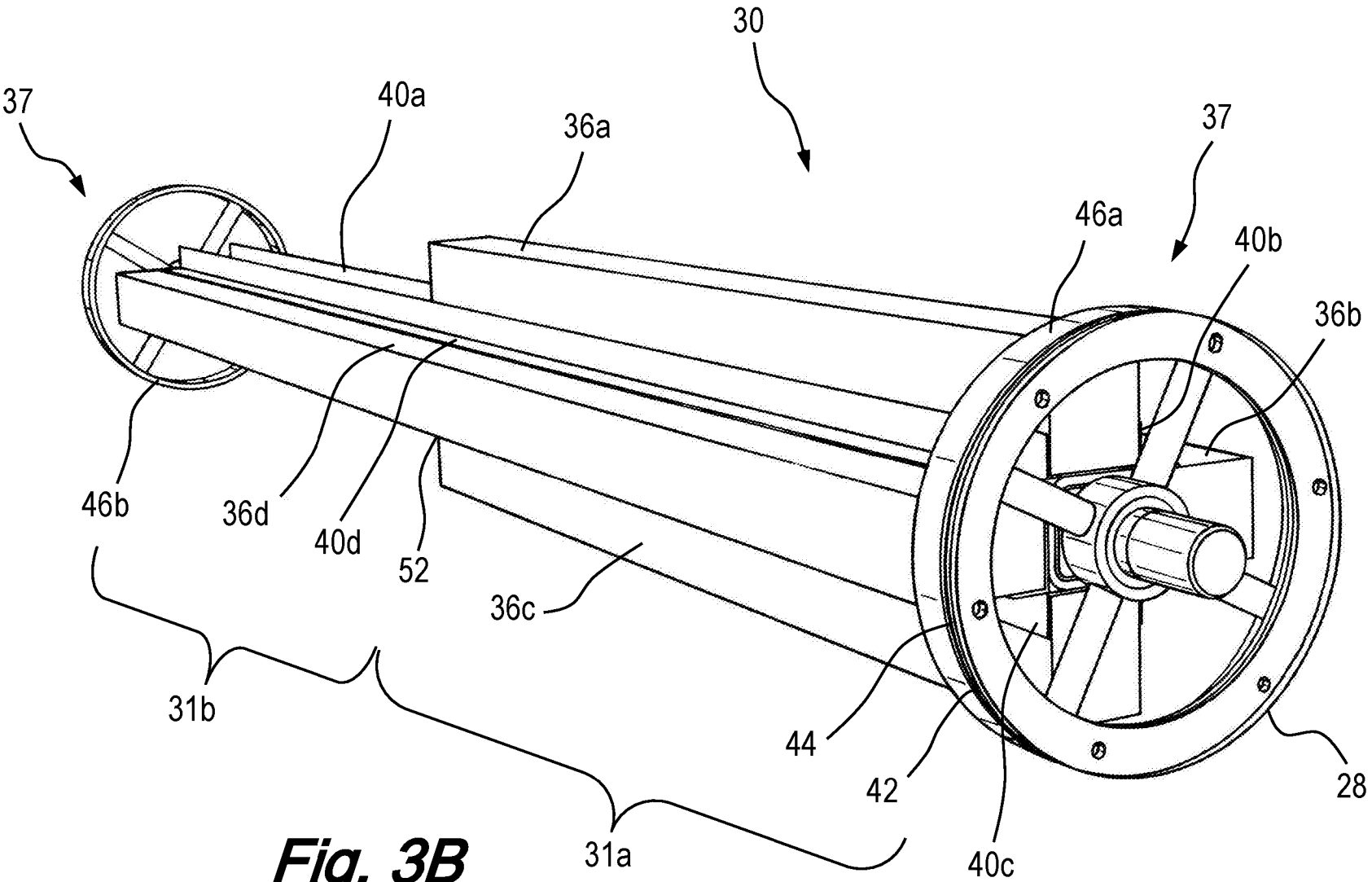

The internal magnet assembly 30 and its drive connections 37 are shown, assembled, in FIG. 3B. In this embodiment, central section 38 of the magnet mounting frame has a substantially square cross section to facilitate the mounting of four magnets. It will be appreciated that central section 38 may be of a different shape to accommodate a different number or arrangement of magnets.

Magnetic groups 36*a* and 36*c* are shorter in length than magnetic groups 36*b* and 36*d*. Therefore, at the first longitudinal portion 31*a* of the apparatus at the input end, four magnetic groups 36*a*, 36*b*, 36*c*, 36*d* are present inside the screw conveyor 29. At the second longitudinal portion 31*b* of the apparatus at the output end of the apparatus, only two magnet groups 36*b*, 36*d* are present. By providing magnetic groups of different lengths, a different magnetic field distribution is produced in the second portion along the longitudinal axis of the apparatus, with a transition point 52 between the two portions of the apparatus where the number and arrangement of magnets which extend along the longitudinal axis of the magnetic separator is changed. Although FIG. 4A only shows one transition point, it will be appreciated that in different magnetic configurations, different or more longitudinal portions and/or multiple transition points may exist. It will also be appreciated that, according to an alternative embodiment, the same number and arrangement of magnets may be provided over the entire longitudinal axis of the apparatus, to produce the same magnetic field distribution along the longitudinal axis of the apparatus. At some longitudinal portions of the apparatus the magnet assembly might comprise no magnets, so as to generate zero magnetic field distribution.

Figure 4A:
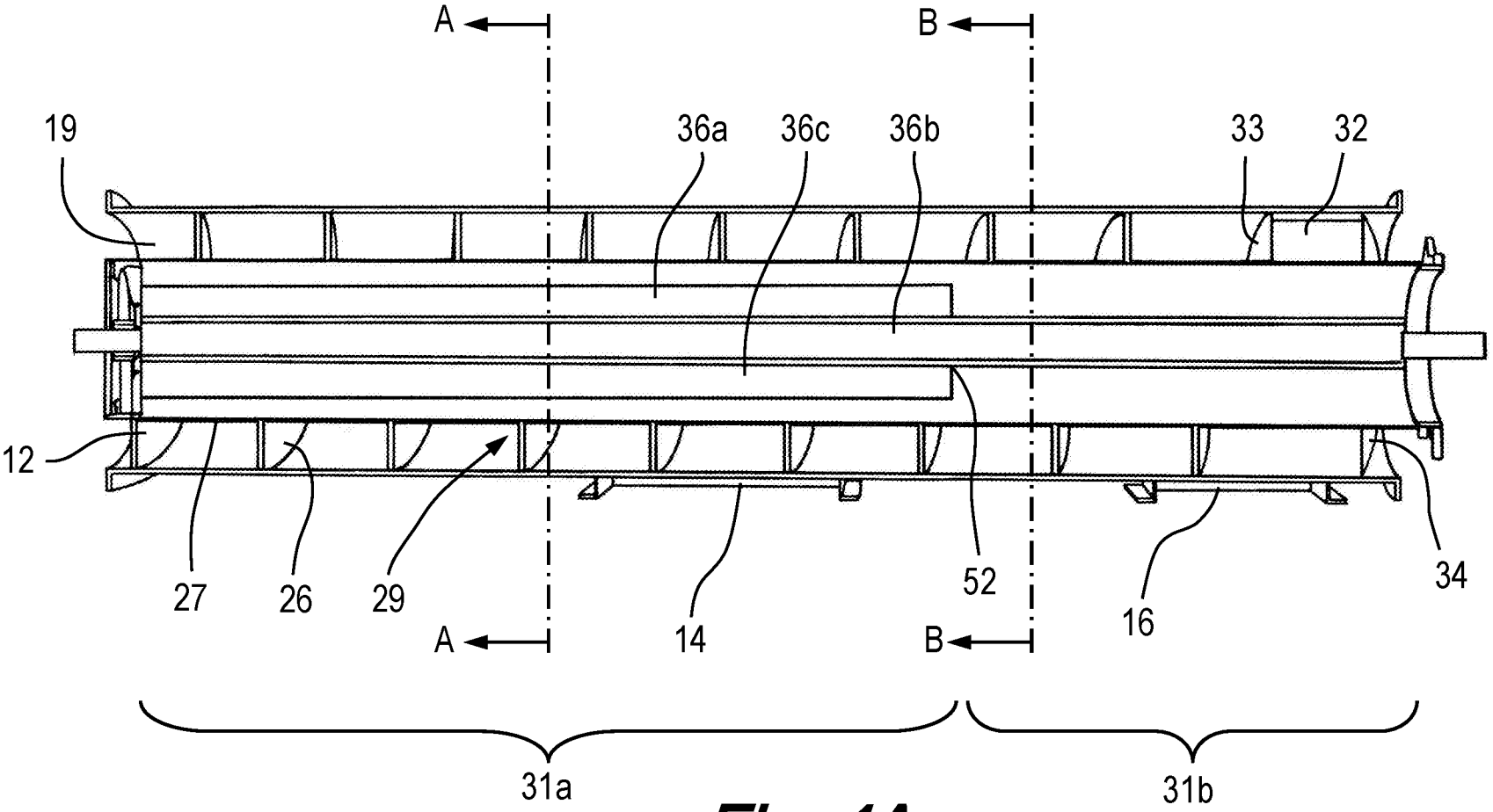
FIGS. 4A to 4C are schematic sectional views of the assembled magnetic separator of FIG. 1A.
Figure 4B:
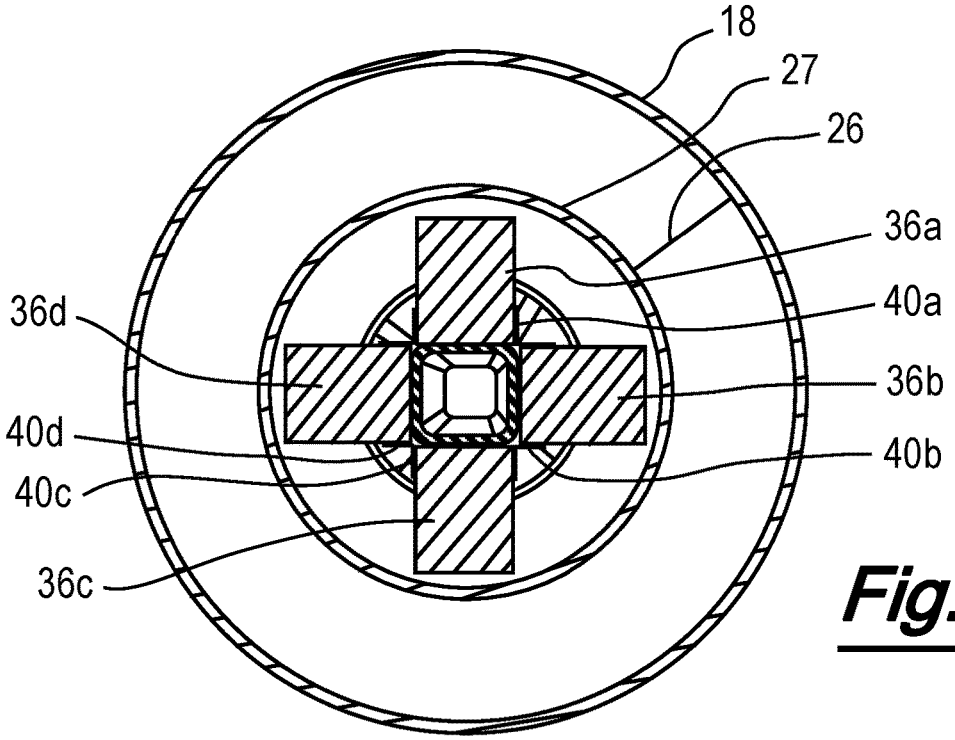
Figure 4C:
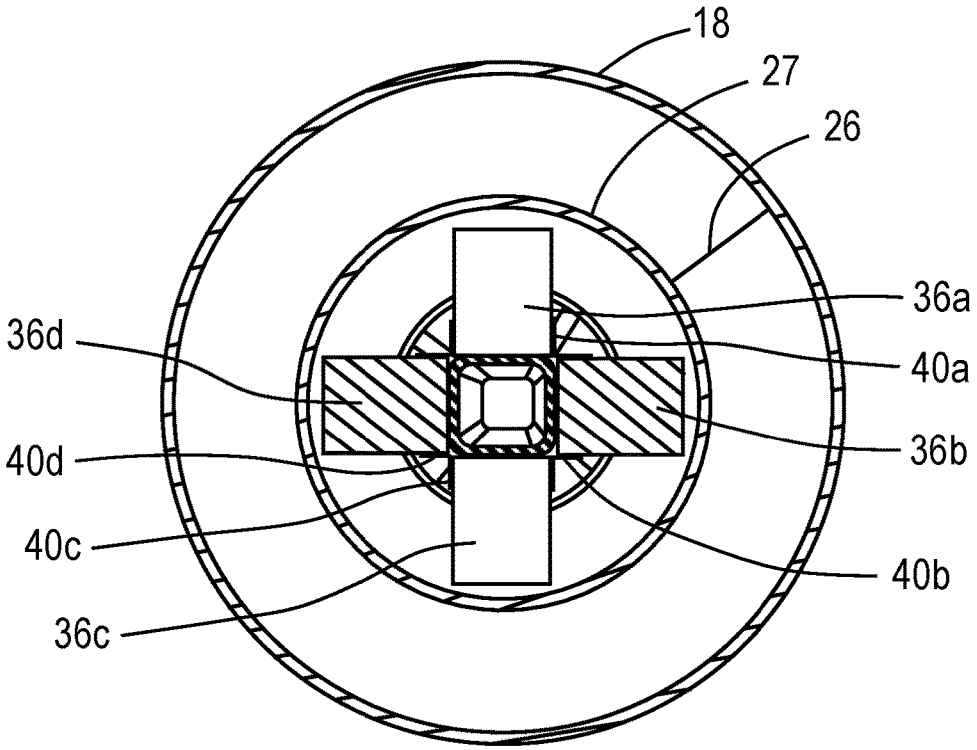

FIG. 4B is a sectional view through the apparatus of FIG. 4A at plane A-A, which intersects the apparatus at a point before the liquid or slurry discharge outlet 14 and transition point 52, at which all four magnets 36*a*, 36*b*, 36*c*, 36*d* of the internal magnet assembly 30 are present. FIG. 4C is a sectional view through the apparatus of FIG. 4A at plane B-B, which intersects the apparatus between the liquid or slurry discharge and ferrous particle outlets 14, 16 respectively, and after transition point 52, at which point magnets 36*a* and 36*c* have ended and only magnets 36*b* and 36*d* remain.

In operation, liquid (or slurry) enters annular volume 19 of the device through inlet 12. The internal magnet assembly 30 of the apparatus remains stationary whilst the screw conveyor 29 (which comprises helical screw flight 26 and inner cylindrical sheath 27) rotates relative to the internal magnet assembly 30 and the outer cylindrical sheath 18. It will be appreciated that in different embodiments of the invention, the magnetic separating apparatus may be driven in a different way.

The liquid flows through the device following a path defined by helical screw flight 26 which occupies annular volume 19. Any ferrous particles which are contained within the liquid are attracted to the outer surface of the inner cylindrical sheath 27 of the screw conveyor 29 by the internal magnet assembly 30 which is situated inside cylindrical sheath 27. As the screw conveyor 29 rotates, these particles are conveyed longitudinally through the apparatus by the helical flights 26, whilst remaining attracted to the outer surface of cylindrical sheath 27. The helical flights 26 of the apparatus also convey non-ferrous particles through the device as the screw conveyor 29 rotates.

The liquid or slurry exits the device when it reaches non-ferrous outlet 14, assisted by gravity, to be diverted or stored elsewhere. Ferrous particles, however, remain attracted to the internal magnet assembly 30 of the screw conveyor 29, which continues to move them longitudinally through the apparatus as the screw conveyor 29 rotates. Ferrous particles are therefore separated from the bulk flow of the liquid.

At a transition point 52 which occurs at a point between non-ferrous and ferrous outlets 14, 16, respectively, the magnetic field strength which is generated by the internal magnet assembly 30 changes. This is achieved by ending magnets 36*a*, 36*c* so that only two magnets 36*b*, 36*d* remain to extend through the length of the apparatus. This results in circumferential areas around the screw conveyor 29 of the apparatus which are exposed to a reduced magnetic field strength or flux density, or a negligible or zero magnetic field strength or flux density.

Figure 5A:
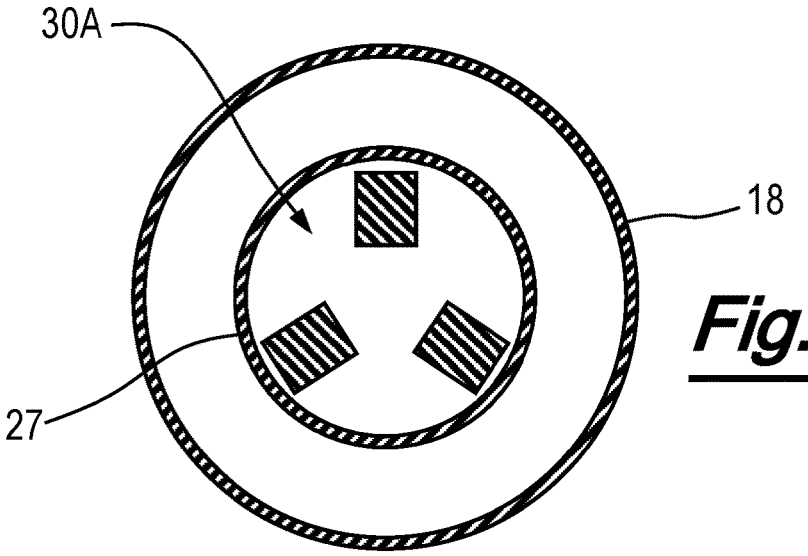
FIGS. 5A to 5C are simplified schematic sectional views of the magnetic separator according to an alternative embodiment of the invention.
Figure 5B:
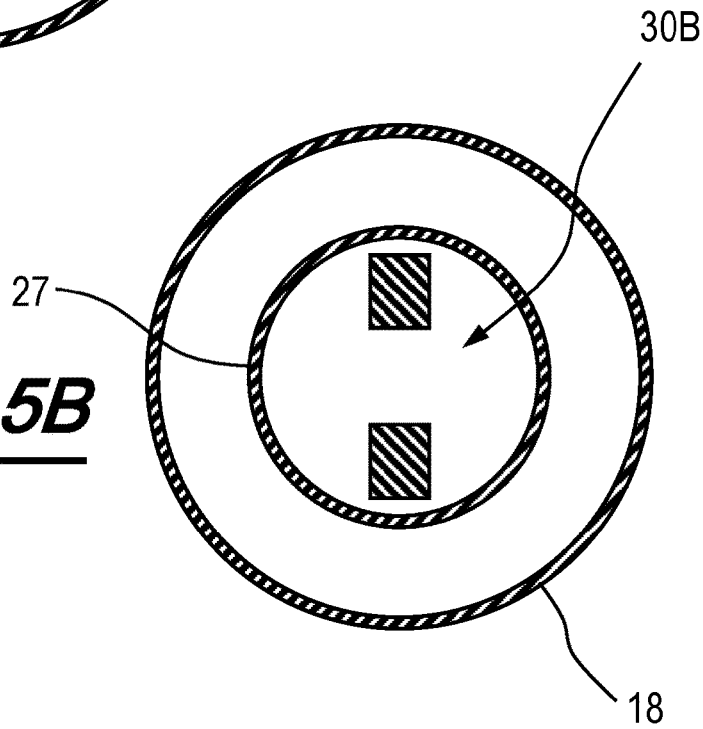
Figure 5C:
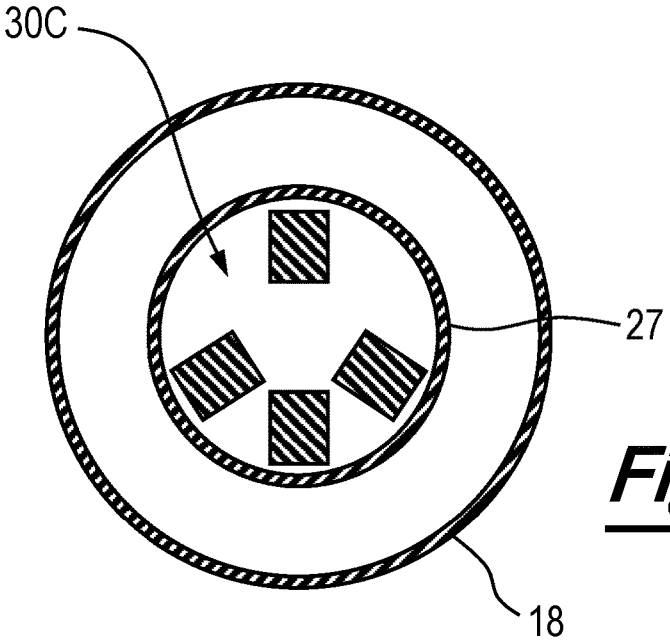

As noted above, the magnets of the internal magnet assembly may be mounted in alternative configurations, including providing different numbers of magnets arranged with different angular spacing between one another, and also including dividing the apparatus up into different longitudinal portions. FIGS. 5A to 5C show simplified schematic cross sectional views through a magnetic separating apparatus, displaying examples of a number of alternative configurations of the magnets of the internal magnet assembly. These examples can apply to magnet assemblies in the first and/or the second longitudinal portions of the apparatus, or both, or in different longitudinal portions as applicable. For clarity, additional components such as drive connections and magnet mounting components have been omitted from these Figures.

The magnetic separating apparatus shown in FIGS. 5A to 5C is substantially the same as that shown in FIGS. 4A to 4C, and will be understood from these figures and the accompanying description, with like features labelled with like reference numerals.

In FIG. 5A, the internal magnet assembly 30A is made up of three magnets, arranged with an angular spacing of approximately 120 degrees between one another.

FIG. 5B shows a preferable magnet arrangement to be provided over the entire longitudinal axis of the apparatus (i.e. what would be the first longitudinal and the second portions of the apparatus). The internal magnet assembly 30B comprises only two magnets, arranged with an angular spacing of approximately 180 degrees between one another, substantially at 12 and 6 o'clock positions. This magnet arrangement is beneficial as it provides sufficient magnetic field strength to attract and convey particles along the apparatus, whilst providing sufficient gaps in magnetic field strength to enable the discharge of particles. In addition, the azimuth angle (i.e. rotational position) of the internal magnet assembly is adjustable with respect to the apparatus to ensure optimum operation of the apparatus It will be appreciated that the angular spacing between the magnets need not be the same, as is shown most clearly in FIG. 5C, in which the internal magnet assembly 30C comprises four magnets with ununiform angular spacing.

Figure 6:
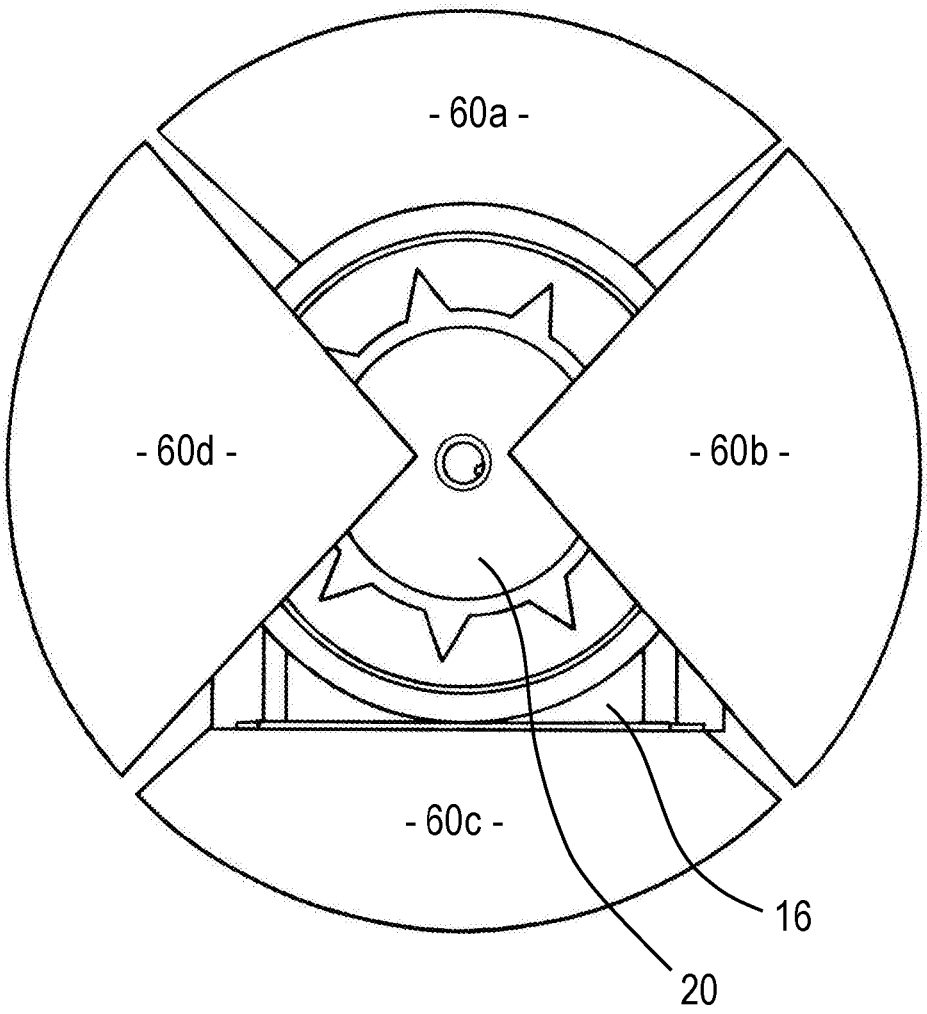
FIG. 6 is a schematic end view of the magnetic separator of FIG. 1A.

FIG. 6 is an end view of the apparatus showing generally the areas towards the end of the conveyor described in FIGS. 3A to 4C which are under the influence of magnetic fields and those which are not. Areas 60*a*, 60*b*, 60*c*, 60*d* represent fields generated by the magnets 36*a*, 36*b*, 36*c*, 36*d*, respectively. In the second longitudinal portion of the apparatus, towards the end of the conveyor, only fields 60*b* and 60*d* (resulting from magnets 36*b* and 36*d*) remain, and the circumferential location of ferrous outlet 16 corresponds to an area of the inner sheath which is not under the influence of a magnetic field. It will be appreciated that the representation of magnetic fields 60*a*, 60*b*, 60*c*, 60*d* as circular sectors is for illustrative purposes, rather than being an accurate representation of the magnetic flux.

Ferrous particles are conveyed through the apparatus until they reach particle release surface 32, which is oriented longitudinally on the surface of the inner sheath. The longitudinal orientation of the particle release surface 32, does not convey the particles any further along the length of the apparatus. As the screw conveyor 29 rotates, particle release surface 32 rotates to sweep the particles which have gathered around it over outlet 16, and through a circumferential area of the conveyor which is no longer subjected to the influence of a magnetic field. As the particles are swept through this area by the particle release surface 32, they are no longer attracted to the inner cylindrical sheath 27 of the screw conveyor 29 and therefore exit the conveyor through outlet 16 under gravity.

Without the provision of particle release surface 32, very small particles would become stuck to the inner cylindrical sheath 17 of the apparatus, unable to move away from areas of higher magnetic field strength. The particle release surface 32 therefore ensures that even very small magnetic particles are directed through the area of low or zero magnetic field which corresponds to outlet 16, ensuring that they are discharged from the apparatus. The magnetic separating apparatus can be integrated into a flowline of a rig package of the oil and gas exploration and production industry, either permanently or temporarily. In such an application, a flowline which contains the liquid or slurry to be treated (referred to in the following description as the main flowline) is intersected by a bypass cleaning line. The bypass cleaning line may be a rubber hose, rigid pipe or an alternative type of fluid conduit. Valves are used to divert the flow from the main flowline through the bypass cleaning line, if desired.

When activated, the bypass cleaning line directs the flow from the main flowline to the magnetic separating apparatus, to which it is coupled via a flange connection which facilitates full bore flow from the bypass cleaning line, through inlet 12, and into annular volume 19 of the magnetic separating apparatus. A discharge line is connected to the liquid or slurry discharge outlet of the magnetic separating apparatus to direct the treated liquid back to the main flowline. Again, a flange connection is used to facilitate full bore flow from the apparatus liquid or slurry discharge outlet to the discharge line. The discharge line intersects the main flowline in a manner similar to the bypass cleaning line, with valves provided to isolate the discharge line from the main flowline if desired. The discharge line may be a rubber hose, rigid pipe or an alternative type of fluid conduit. A collection vessel or conduit is provided at the ferrous particle outlet of the magnetic separating apparatus to either store or redirect ferrous discharge from the apparatus.

The apparatus may be selectively brought online by opening the valve, or valves, between the main flowline and the bypass cleaning line and the valve, or valves, between the discharge line and the main flowline. Similarly, by closing these valves, the magnetic separating apparatus may be isolated from the main flowline and bypassed during normal operation.

In an alternative embodiment, the magnetic separating apparatus may be mounted at an angle with its inlet 12 extending into a fluid ditch or open flowline which contains a fluid or a slurry with ferrous material content. A mounting frame or other type of arrangement may be used to install the apparatus in such a way. In such an embodiment, the outer cylindrical sheath 18 of the magnetic separating apparatus is fully or partially removed in order to provide greater exposure between the inlet of the screw conveyor 29, particularly the magnetic field strength which it generates, and the ferrous particles which occupy the surrounding fluid. This allows the screw conveyor 29 to better attract and collect particles from the fluid, resulting in more efficient separating. In this embodiment, it is preferable that the internal magnet assembly 30 of the apparatus is rotatably driven relative to the screw conveyor 29 to convey particles over the length of the apparatus, whilst the screw conveyor 29 itself remains stationary. This is to avoid the provision of non-enclosed moving parts, which are more likely to become damaged and may pose a safety risk to personnel and other machinery.

Such an embodiment works in a similar way to that of the embodiment explained in the foregoing description, however, the apparatus is not intended to convey liquid or slurry. Instead the apparatus is intended to simply collect, convey and separate ferrous matter from a liquid or a slurry. For this reason, no liquid or slurry outlet is provided on the apparatus. An outlet or collection point for ferrous particles is provided in a substantially similar location to outlet 16 of the separator of the previously described embodiment, and ferrous material is discharged from the apparatus in the same way.

Figure 7A:
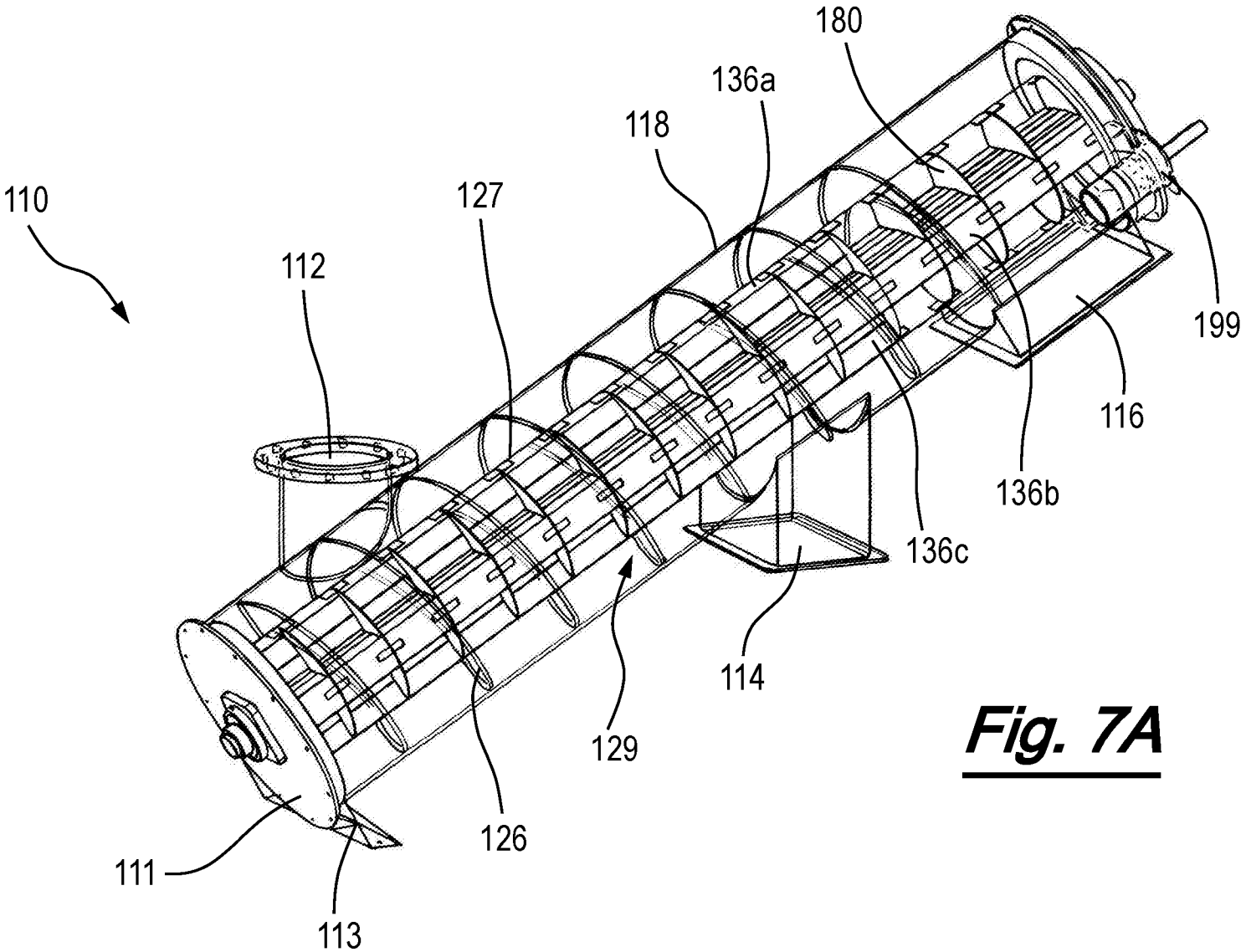
FIGS. 7A and 7B are isometric and side views respectively of a magnetic separating apparatus according to an alternative embodiment of the invention.
Figure 7B:
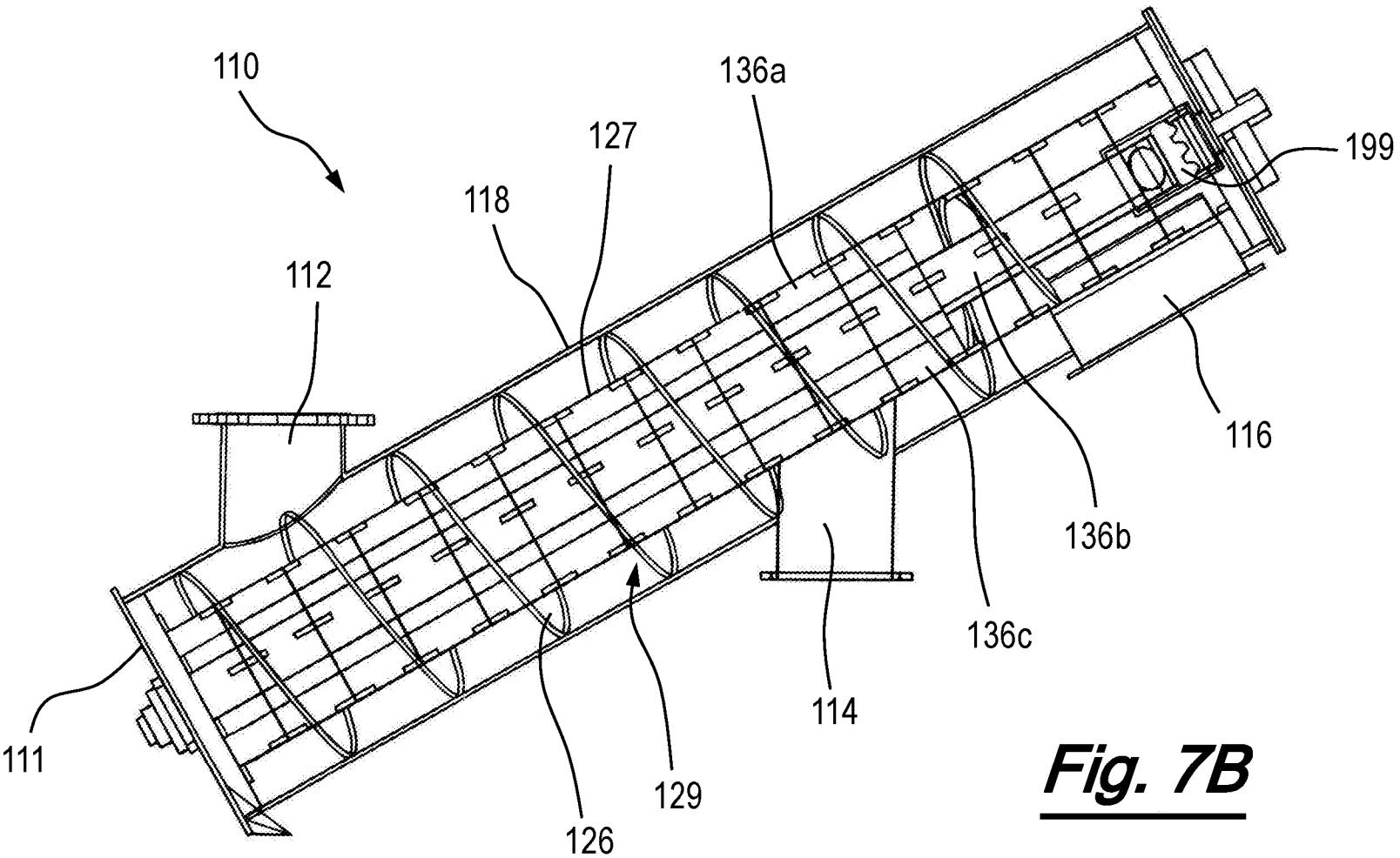

While the figures and the foregoing description show and describe the inlet of the magnetic separating apparatus as being located coaxially at the front end of the conveyor, it should be appreciated that the inlet may be located elsewhere. It should also be appreciated that the stand at the front end of the conveyor may be of various shapes to support the orientation of the conveyor. For example, FIGS. 7A and 7B show an alternative embodiment of the magnetic separating apparatus 110 with an enclosed front end 111, and a radially positioned inlet 112. The stand 113 at the front end of the conveyor is formed with an angled base to facilitate orienting the apparatus at an incline.

FIGS. 7A and 7B show a hydraulic motor 199 mounted to the outer cylindrical sheath 118 of the apparatus. The motor 199 is used to rotate the screw conveyor 129 (which comprises inner cylindrical sheath 127 and helical screw flight 126) of the apparatus relative to the internal magnet assembly 130 and the outer cylindrical sheath 118. It should be appreciated that a different type of motor may be used, and that the motor may positioned in a different location with respect to the apparatus. A motor may also be provided to rotate the internal magnet assembly 130 of the apparatus.

Figure 8A:
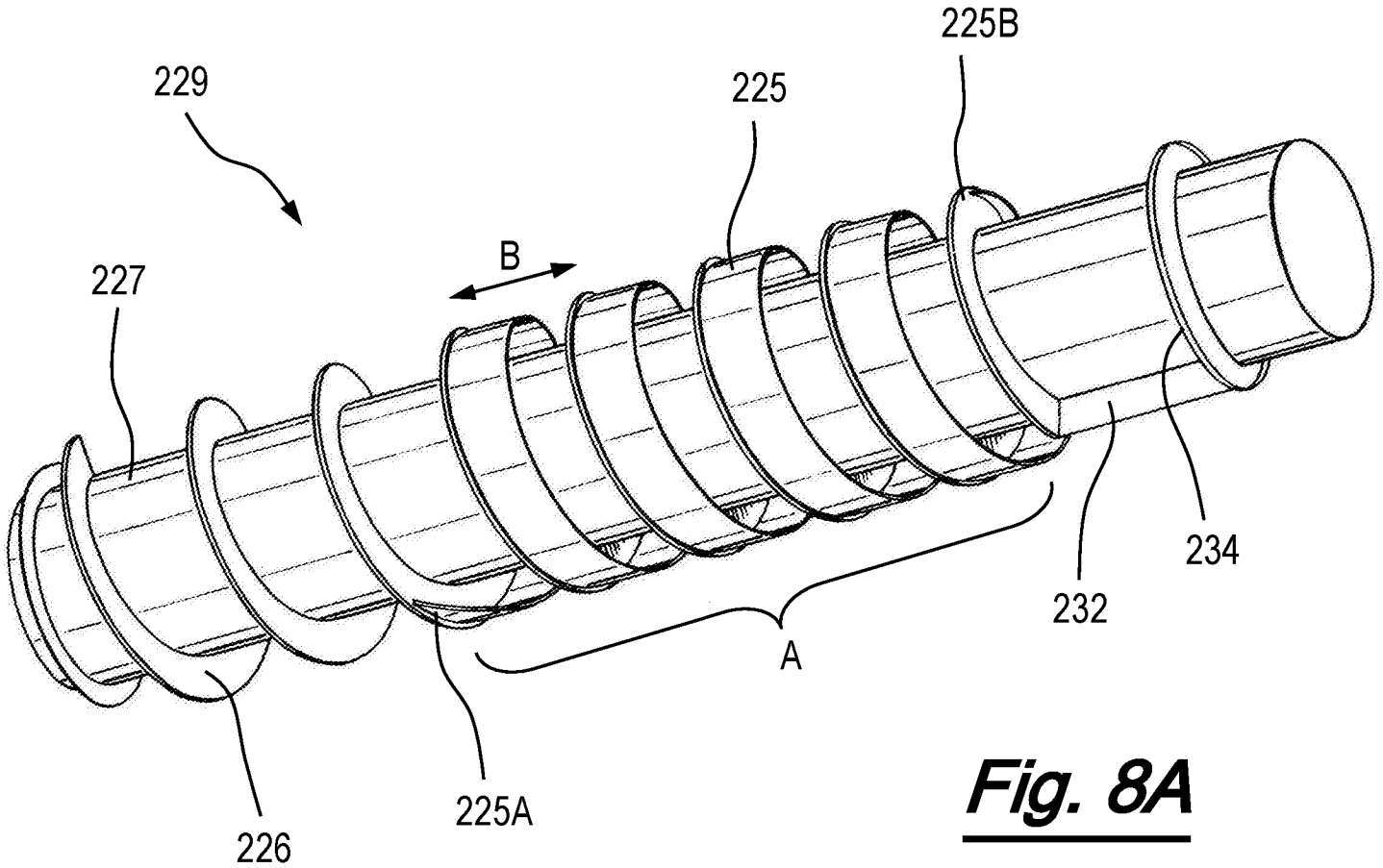
FIG. 8A is a schematic isometric view of a screw conveyor of a magnetic separator according to an alternative embodiment of the invention.
Figure 8B:
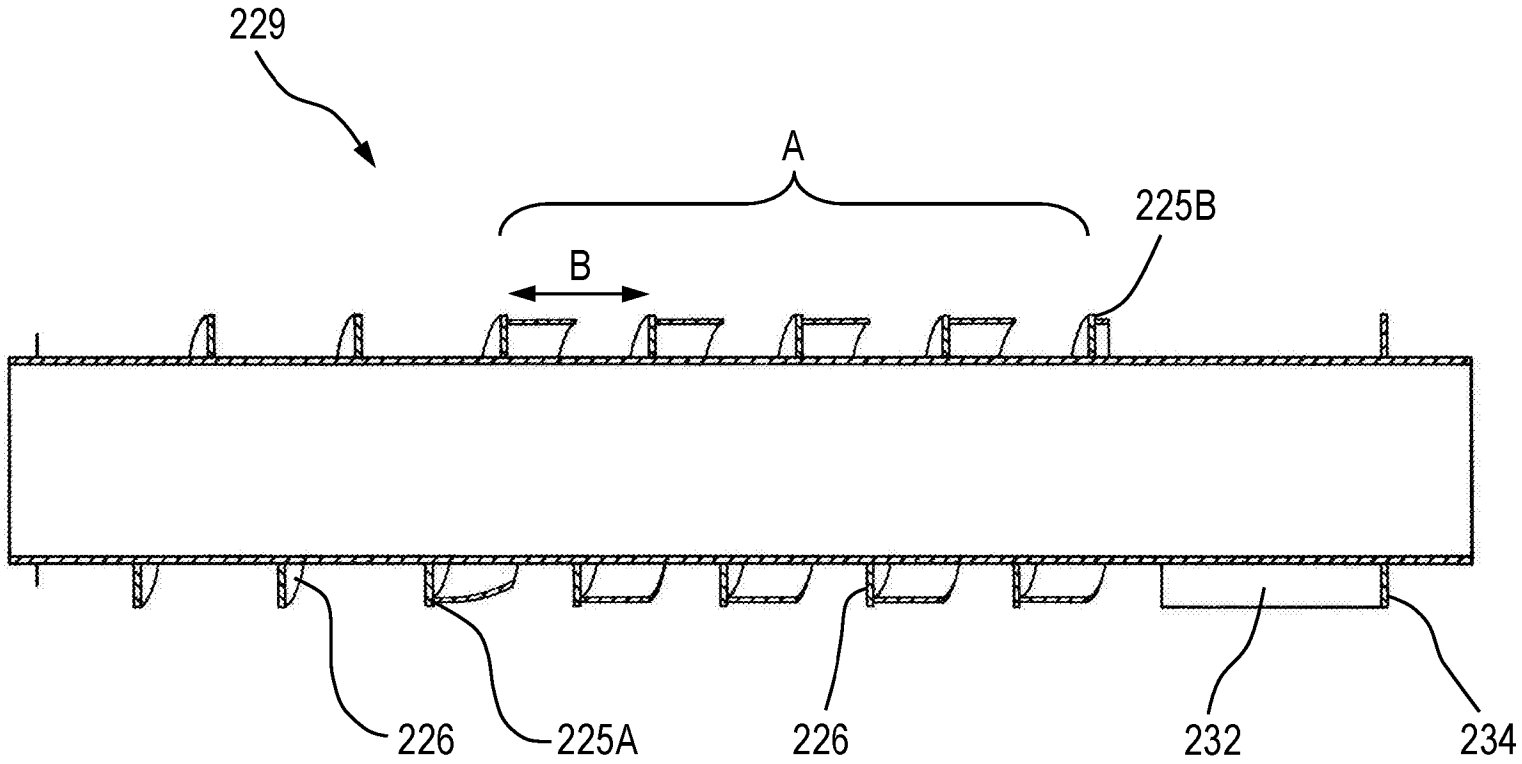
FIG. 8B is a schematic sectional view of the screw conveyor of the magnetic separator of FIG. 8A.

According to a preferred embodiment of the invention, the helical screw flight of the screw conveyor of the magnetic separating apparatus can be further provided with a retaining surface, as shown in FIGS. 8A and 8B.

The screw conveyor 229 of the magnetic separating apparatus is the same as screw conveyor 29, and will be understood from FIG. 2 and the accompanying description, with like features labelled with like reference numerals incremented by 200.

FIGS. 8A and 8B show the screw conveyor 229 with the external sheath and other such components omitted for clarity. The helical screw flights 226 have been provided with a retaining surface 225. The retaining surface 225 can be provided over the whole length of the screw conveyor, or, alternatively, over only some of its length. In these figures, the retaining surface 225 is only provided over only a portion A of the length of the whole conveyor 229, beginning at point 225A and ending at point 225B. The retaining surface tapers towards its starting and end points 225A, 225B, respectively.

The depth of the retaining surface is approximately half of the pitch B of the helical screw flights 226. However, it will be appreciated that the depth of the retaining surface may be varied, as applicable. It must be deep enough to ensure that particles are contained whilst still allowing liquid or slurry to escape.

Figure 8C:
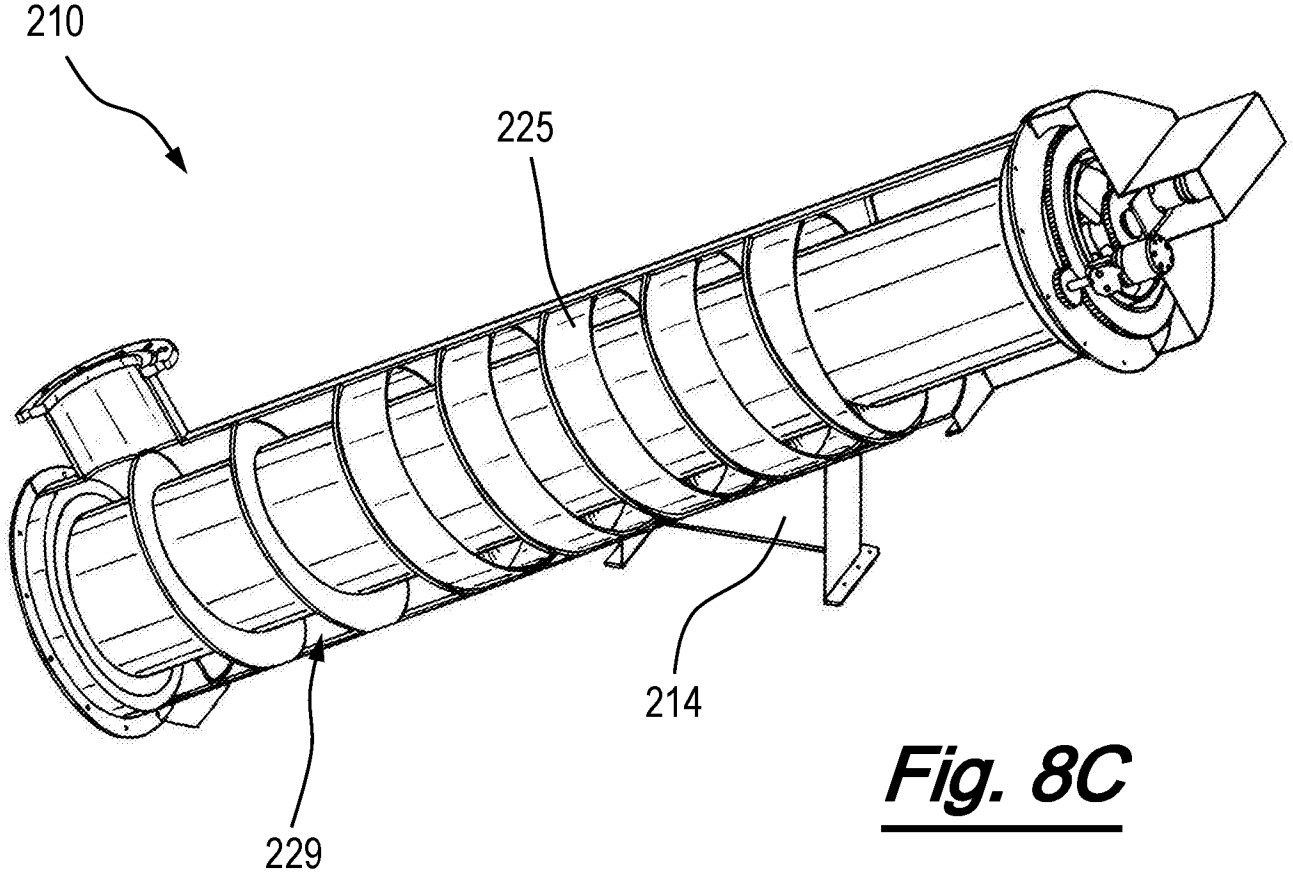
FIG. 8C is an isometric view of an assembled magnetic separating apparatus comprising the screw conveyor according to FIGS. 8A and 8B.

It is beneficial to provide the retaining surface on the screw conveyor generally in the region of the liquid or slurry discharge outlet, in order to prevent any egress of collected particles at this location, whilst still allowing liquid or slurry to discharge at this point. This is most clearly shown in FIG. 8C, which shows an assembled magnetic separating apparatus 210, substantially the same as that described with reference to FIGS. 7A and 7B, with sections of the outer sheath removed for clarity, incorporating the screw conveyor 229 with retaining surface 225 as described in FIGS. 8A and 8B. The retaining surface 225 begins in the first longitudinal portion of the apparatus, after the inlet and before the liquid or slurry discharge outlet 214. The retaining surface extends through the first longitudinal portion of the apparatus, past the liquid or slurry discharge outlet 214 and ends at or before the second longitudinal portion of the apparatus.

Access to the apparatus by the liquid or slurry to be treated is unimpeded as the retaining surface 225 is not provided in the region of the inlet. Likewise, egress of the collected particles is not effected by the retaining surface 225, which is omitted at the ferrous particle collection location. However, collected particles are successfully retained by the retaining surface 225 around the liquid or slurry discharge outlet 214.

It will be appreciated that, even though not expressly shown, all of the embodiments of the apparatus which have been described in the foregoing description can be provided with a helical sheath on some or all the helical screw flights of the screw conveyor of the magnetic separating apparatus.

Figure 9:
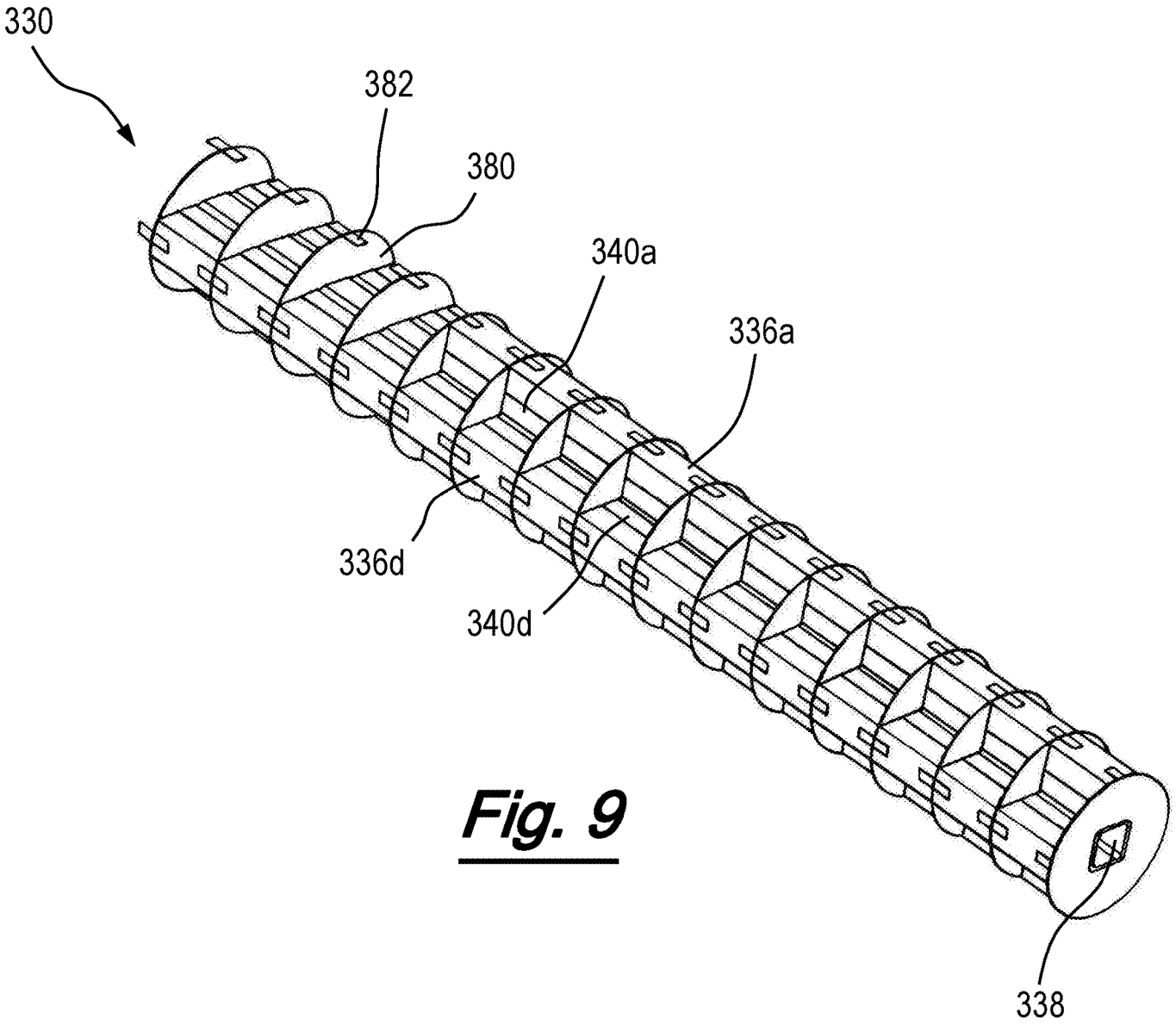
FIG. 9 is an isometric view of an assembled internal magnet assembly according to an alternative embodiment of the invention.
Figure 11:
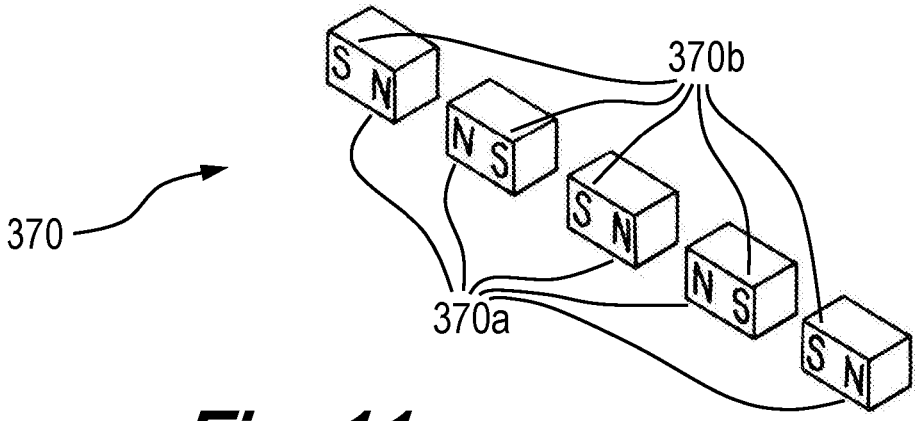
FIG. 11 is a schematic representation of the magnets of the magnetic groups of the internal magnet assembly of FIG. 9.

FIGS. 9 to 11 show internal magnet assembly of a preferred embodiment of the invention. In this embodiment, the magnet assembly, generally shown at 330, is formed from a plurality of longitudinal magnet groups, each comprising smaller magnetic units assembled in a repelling orientation together with spacing discs. FIG. 11 shows magnets which form each of the longitudinal magnetic groups 336*a*, 336*b*, 336*c*, 336*d* installed with repelling poles adjacent to one another. The north pole 370*a* of one magnet is installed adjacent to the north pole 370*a* of the next, similarly for south poles 370*b*. The spacing discs 380 are formed from a non-magnetic material such as a non-magnetic stainless steel, and are most clearly shown in exploded view FIG. 10. Each disc is a substantially circular planar disc, comprising a rectangular aperture in its centre which permits it to be slotted on to central section 338. Arranged around the outer edges of the discs are a plurality of retaining plates 382, oriented longitudinally with respect to the apparatus, and in circumferential positions corresponding to the positions of the magnets.

To assemble the magnet assembly, a first spacing disc 380 is slotted on to central section 338. Magnet mount sections 340*a*, 340*b*, 340*c*, 340*d* are then slid towards spacing disc 380 and secured place on central section 338. Longitudinal magnetic groups 336*a*, 336*b*, 336*c*, 336*d* are formed from assemblies of magnetic units 335*a*, 335*b*, 335*c*, 335*d*. The magnetic units 335*a*, 335*b*, 335*c*, 335*d* which make up magnetic groups 336*a*, 336*b*, 336*c*, 336*d* are then inserted into their respective magnet mounts with their first ends positioned under retaining plates 382 of disc 380. The next disc 380 is then slotted into place with retaining plates 382 securing the second ends of the magnets. The magnets are therefore fully secured under retaining plates 382 of discs 380. The installation process is repeated along the length of central section 338 until the magnet assembly reaches the desired length.

This type of assembly (i.e. spacing discs and retaining plates) can also be used for internal magnet assemblies which have alternative mounting configurations, including those with different numbers of magnets arranged at different angular spacings.

The invention provides an apparatus for removing ferrous particles from an oil or gas process liquid or slurry and a method of use. In one aspect, the apparatus comprises a first inner cylindrical sheath and a second outer cylindrical sheath arranged concentrically on a longitudinal axis to create an annular volume. At least one helical screw flight on one of the first or second cylindrical sheaths extends substantially or fully across the annular volume, and a magnet assembly extends along at least a part of the longitudinal axis, such that ferrous particles are attracted to an internal cylindrical surface of the annular volume. The apparatus comprises an inlet for a liquid or slurry to enter the annular volume, a liquid or slurry discharge outlet from the annular volume, and a ferrous particle collection location at one end of the apparatus. The screw flight and the cylindrical sheath on which it is mounted are operable to be rotated with respect to the magnet assembly to convey particles along the apparatus to the ferrous particle collection location. The apparatus further comprises a a retaining surface configured to retain collected particles as they are conveyed towards the ferrous particle collection location.

In another aspect the apparatus comprises a first inner cylindrical sheath and a second outer cylindrical sheath arranged concentrically on a longitudinal axis to create an annular volume. At least one helical screw flight on one of the first or second cylindrical sheaths extends substantially or fully across the annular volume, and a magnet assembly extends along at least a part of the longitudinal axis, such that ferrous particles are attracted to an internal cylindrical surface of the annular volume. The apparatus comprises an inlet for a liquid or slurry to enter the annular volume, a liquid or slurry discharge outlet from the annular volume, and a ferrous particle collection location at one end of the apparatus. The screw flight and the cylindrical sheath on which it is mounted are operable to be rotated with respect to the magnet assembly to convey particles along the apparatus to the ferrous particle collection location. The magnet assembly extends over a first longitudinal portion of the apparatus to provide a first magnetic field distribution for attracting ferrous particles to a surface in the annular volume, and extends over a second longitudinal portion of the apparatus proximal the ferrous particle collection location to provide a second magnetic field distribution. The apparatus further comprises a particle release surface, oriented substantially longitudinally in the annular volume in the second longitudinal portion of the apparatus and adjacent the ferrous particle collection, and the particle release surface is operable to be rotated with respect to the magnet assembly to move ferrous particles around the apparatus to region of low magnetic field strength and release them at the ferrous particle collection location.

The invention addresses one or more drawbacks of known methods and/or apparatus, by providing improved discharge of ferrous particles, and providing an improved apparatus and method of use which can be integrated, permanently or otherwise, into a flowline of a rig package.

Various modifications to the above-described embodiments may be made within the scope of the invention. For example, the retaining surface as described with reference to FIGS. 8A to 8C may be used with or without an apparatus which has different longitudinal portions, and may be used with or without an apparatus which is provided with a particle release surface, and vice versa. In non-illustrated embodiments of the invention, the apparatus may comprise multiple (e.g. double or triple) continuous helical screw flights on the same apparatus. The invention extends to combinations of features other than those expressly claimed herein.

The invention claimed is:

1. An apparatus for removing ferrous particles from an oil or gas process liquid or slurry, the apparatus comprising:

a first inner cylindrical sheath and a second outer cylindrical sheath arranged concentrically on a longitudinal axis to create an annular volume therebetween;

at least one helical screw flight on one of the first or second cylindrical sheaths, and extending substantially or fully across the annular volume;

a magnet assembly arranged inside the first inner cylindrical sheath and extending along at least a part of the longitudinal axis, configured to attract ferrous particles to a cylindrical surface of the first inner cylindrical sheath internal to the annular volume;

an inlet for a liquid or slurry to enter the annular volume;

a liquid or slurry discharge outlet from the annular volume;

a ferrous particle collection location at one end of the apparatus;

wherein the at least one screw flight and the first or second cylindrical sheath on which the at least one screw flight is mounted is operable to be rotated with respect to the magnet assembly to convey particles along the apparatus to the ferrous particle collection location; and wherein the at least one helical screw flight of the apparatus further comprises a retaining surface in the form of a wall or barrier which extends in the longitudinal direction of the apparatus configured to retain collected particles as the collection particles are conveyed towards the ferrous particle collection location.

2. The apparatus according to claim 1, wherein the retaining surface extends in the longitudinal direction of the apparatus from at least part of the radial outer edge of the at least one helical screw flight.

3. The apparatus according to claim 1, wherein the retaining surface extends in a direction in which liquid or slurry moves and/or flows through the apparatus, towards the end of the apparatus at which the ferrous particle collection location is located.

4. The apparatus according to claim 1, wherein the retaining surface extends from at least part of the radial outer edge of the at least one helical screw flight by around 20% to 80% of the distance of the pitch of the at least one helical screw flight.

5. The apparatus according to claim 1, wherein the retaining surface tapers towards its start and end points.

6. The apparatus according to claim 1, wherein the retaining surface is provided on the at least one helical screw flight on at least the portion located adjacent to the liquid or slurry discharge outlet.

7. The apparatus according to claim 6, wherein the retaining surface is omitted from the at least one helical screw flight on the portion located adjacent to the inlet of the apparatus and the portion located adjacent to the ferrous particle collection location.

8. The apparatus according to claim 1, wherein the apparatus is oriented with its longitudinal axis at an incline to the horizontal.

9. The apparatus according to claim 1, wherein the magnet assembly comprises a plurality of magnets positioned inside the first inner cylindrical sheath of the apparatus.

10. The apparatus according to claim 9, wherein the plurality of magnets of the magnet assembly is supported in a magnet mounting frame.

11. The apparatus according to claim 1, wherein the magnet assembly extends over a first longitudinal portion of the apparatus and provides a first magnetic field distribution which attracts ferrous particles to a surface in the annular volume, and wherein the magnet assembly extends over a second longitudinal portion of the apparatus, which is proximal the ferrous particle collection location, and which provides a second magnetic field distribution.

12. The apparatus according to claim 11, wherein the first longitudinal portion of the apparatus extends from the inlet of the apparatus, to a point past the liquid or slurry discharge outlet and the second longitudinal portion of the apparatus extends from a point past the liquid or slurry discharge outlet to the ferrous particle collection location.

13. The apparatus according to claim 11, wherein the first magnetic field distribution generated by the magnet assembly is such that the magnetic field strength is greater than the second magnetic field distribution, on average, over the surfaces of the inner cylindrical sheath in the first and second longitudinal portions of the apparatus.

14. The apparatus according to claim 11, wherein the second magnetic field distribution is such that the magnetic field strength is reduced compared with the first magnetic field distribution, and is negligible or zero over circumferential portions of first inner cylindrical sheath.

15. The apparatus according to claim 10, wherein the plurality of magnets comprises a plurality of longitudinal magnets, each of which comprise a plurality of magnetic units, wherein the plurality of longitudinal magnets is circumferentially distributed around the longitudinal axis of the apparatus.

16. The apparatus according to claim 15, wherein, where the apparatus is divided into first and second longitudinal portions, the first longitudinal portion comprises a plurality of longitudinal magnets circumferentially distributed around the longitudinal axis of the apparatus and the second longitudinal portion comprises at least one longitudinal magnet circumferentially distributed around the longitudinal axis of the apparatus.

17. The apparatus according to claim 15, wherein the plurality of magnetic units of each longitudinal magnet may be arranged with their repelling poles adjacent to one another.

18. The apparatus according to claim 15, wherein the magnet assembly comprises one or more spacers in the form of spacing plates or spacing discs arranged between adjacent magnetic units of the longitudinal magnets.

19. The apparatus according to claim 18, wherein the magnet assembly of the apparatus comprises a retaining means which is operable to retain the magnetic units in place against a repelling force.

20. The apparatus according to claim 1, further comprising a particle release surface oriented substantially longitudinally in the annular volume of the apparatus and located adjacent the ferrous particle collection location.

21. The apparatus according to claim 20, wherein the particle release surface is operable to be rotated with respect to the magnet assembly and to move ferrous particles around the apparatus into a region of low magnetic field strength to release them at the ferrous particle collection location.

22. The apparatus according to claim 1, comprising a motor operable to drive the apparatus in several different ways, selected from a group consisting of: rotating the screw conveyor whilst the internal magnet assembly remains stationary; rotating the internal magnet assembly whilst the screw conveyor remains stationary; and simultaneously rotating the screw conveyor and the internal magnet assembly relative to one another, either in the same or in opposite directions.

23. A method of removing magnetic particles from an oil or gas process liquid or slurry, the method comprising:

providing a magnetic separating apparatus comprising:

a cylindrical sheath on a longitudinal axis;

at least one helical screw flight on the cylindrical sheath;

a magnet assembly arranged inside the cylindrical sheath and extending along at least a part of the longitudinal axis; and a ferrous particle collection location;

wherein the at least one helical screw flight of the apparatus further comprises a retaining surface in the form of a wall or barrier which extends in the longitudinal direction of the apparatus;

exposing the cylindrical sheath to an oil or gas process liquid or slurry such that ferrous particles which are contained within the liquid or slurry are attracted to the outer surface of the cylindrical sheath by the magnet assembly;

rotating the cylindrical sheath and the at least one helical screw flight relative to the magnet assembly to convey particles along the apparatus towards the ferrous particle collection location;

retaining collected particles using the retaining surface; and releasing particles at the ferrous particle collection location.

24. The method according to claim 23, wherein the retaining surface extends in the longitudinal direction of the apparatus from at least part of the radial outer edge of the at least one helical screw flight and is configured to retain collected particles as the collected particles are conveyed towards the ferrous particle collection location.

25. The method according to claim 23, wherein the apparatus further comprises a particle release surface oriented substantially longitudinally on the cylindrical sheath adjacent the ferrous particle collection, and wherein the method comprised rotating the cylindrical sheath and the at least one helical screw flight relative to the magnet assembly to convey particles along the apparatus toward the particle release surface.

26. The method according to claim 25, wherein the method comprises rotating the particle release surface relative to the magnet assembly to move ferrous particles around the apparatus to a region of low magnetic field strength and release them at the ferrous particle collection location.

27. An oil or gas exploration or production facility comprising the apparatus according to claim 1.

* * * * *